US007316880B2

(12) United States Patent
Yamauchi et al.

(10) Patent No.: US 7,316,880 B2
(45) **Date of Patent: *Jan. 8, 2008**

(54) TONER FOR DEVELOPING A LATENT IMAGE AND AN IMAGE FORMING METHOD EMPLOYING THE SAME

(75) Inventors: Yasuko Yamauchi, Hachioji (JP); Hiroshi Yamazaki, Hachioji (JP); Masafumi Uchida, Toyokawa (JP); Kenji Yamane, Sagamihara (JP)

(73) Assignee: Konica Minolta Holdings, Inc. (JP)

( * ) Notice: Subject to any disclaimer, the term of this patent is extended or adjusted under 35 U.S.C. 154(b) by 488 days.

This patent is subject to a terminal disclaimer.

(21) Appl. No.: 10/924,095

(22) Filed: Aug. 23, 2004

(65) Prior Publication Data

US 2005/0058925 A1 Mar. 17, 2005

(30) Foreign Application Priority Data

Aug. 26, 2003 (JP) ..... 2003-301141

(51) Int. Cl.
*G03G 9/08* (2006.01)

(52) U.S. Cl. ..... 430/108.6; 430/108.7; 430/110.1

(58) Field of Classification Search ..... 430/108.6, 430/108.7, 110.1
See application file for complete search history.

(56) References Cited

U.S. PATENT DOCUMENTS

| | | | | |
|---|---|---|---|---|
| 6,087,059 | A * | 7/2000 | Duggan et al. | 430/108.22 |
| 6,187,497 | B1 | 2/2001 | Kushi et al. | |
| 6,296,980 | B1 | 10/2001 | Oshiba et al. | |
| 6,921,619 | B2 | 7/2005 | Ohmura et al. | |
| 2003/0027066 | A1 | 2/2003 | Yamashita et al. | |
| 2003/0134217 | A1 | 7/2003 | Combes et al. | |

FOREIGN PATENT DOCUMENTS

| | | |
|---|---|---|
| JP | 2001-66820 | 3/2001 |
| JP | 2002148848 | * 5/2002 |
| JP | 2002-287410 | 10/2002 |

OTHER PUBLICATIONS

English Abstract for Japanese Patent No. 2001-066820 dated Mar. 16, 2001.
English Abstract for Japanese Patent No. 2002-287410 dated Oct. 3, 2002.

* cited by examiner

*Primary Examiner*—John L Goodrow
(74) *Attorney, Agent, or Firm*—Cantor Colburn LLP

(57) ABSTRACT

A toner for developing an electrostatic charge image comprising a resin, a colorant, and a particle having domain-matrix structure and the particle having two or more kinds of metal elements.

20 Claims, 3 Drawing Sheets

TONER HAVING NO CORNERS

TONER HAVING CORNERS

TONER HAVING CORNERS

TONER FOR DEVELOPING A LATENT IMAGE AND AN IMAGE FORMING METHOD EMPLOYING THE SAME

BACKGROUND

1. Field of the Invention

The present invention relates to a toner for developing an electrostatic charge image and an image forming method employing the same.

2. Relation Art

A dry developing system employing a magnet brush is usually utilized for an electrophotographic image forming method using an electrostatic charge image developing toner from the view point of simplicity. In the field of the technology of the electrophotography, development competition of a compact color printer capable of forming a high quality image with high speed is become severe.

A cleanerless process is cited as a technique for realizing the compactness of the color printer in which removing of the cleaner unit is made possible by applying the charging and developing bias while designing the transfer means to be simple and compact (Japanese Patent Publication Open to Public Inspection, hereinafter-referred to as Japanese Patent O.P.I. Publication No. 2002-132015).

As to solving the above subject regarding the apparatus, an image forming method employing a polymerized toner prepared by a polymerization method is noted since a high quality toner image excellent in the fine line reproducibility is obtained when the image formed by the use of a small particle diameter polymerized toner having a sharp distribution of particle diameter and that of shape (Japanese Patent O.P.I. Publication No. 2000-214629, equiv. U.S. Pat. No. 6,296,980).

The polymerized toner is advantageous for making compact the apparatus since in such the toner, the charge of the toner particles is uniform so as to obtain high transference ability can be obtained and the toner has suitability to the cleanerless process.

Many kinds of external additives tend to be added to the polymerized toner for raising the transferring ability. In the process employing the usual cleaning system, many kinds of external additive are also employed.

By the addition of the large amount of the external additive, a problem is caused that the adhering and fixing strength of the external additives on the toner particle surface is weak and the external additives are easily released from the toner particle.

The reason of such the problem has been considered that the majority of the toner particles prepared by the polymerization method have no corner on the surface thereof so that the external additives can not be strongly trapped on the toner particle surface.

The problems posed by the releasing of the external additive from the toner particle are cited as follows.

(a) In the case of a double-component developer, for example, the external additives released from the toner particles are moved to the carrier or the surface of a developing roller having a triboelectric charging member and the triboelectric charge is hindered by the contamination of them so as to cause insufficient charging. As a result of that, the life of the developer and the developing device is shortened.

(b) The released external additive is stuck or polishes the surface of the heating roller of the fixing device or the photoreceptor and causes an irregular point (such as a damage). The toner offset or insufficient lowering of the potential occurs at the irregular point and faults so called in the field of the art as the black spot or white spot are formed.

(c) The released external additive contaminates the charging device and the insufficient charging occurs at the contaminated portion and white a halftone line image is resulted.

The released external additive contaminates the surface of the carrier and causes fluctuation or rising of the charged potential particularly under a low temperature and humidity condition so as to form fogging of the image.

A large diameter external additive considerably causes the problems of releasing since the adhering and fixing force of such the additive is weak even though such the additive has a merit on the transfer development. Here, the large diameter external additive is supposed particles having a primary particle diameter of from 40 to 1,000 nm.

Large particle diameter silica is effective to strengthen the adhering and fixing force of the external additive with the toner particle. However, the large particle diameter silica shows high charging ability and causes a problem of the increasing in the charging amount of the toner, and such the silica further causes problems, when it is employed in combination with a small diameter photoreceptor, that peeling discharge tends to occur on the occasion of the separation of the image receiving material from the photoreceptor by which unevenness in the halftone image (frequently called as transfer repelling in the field of the art) tends to occur. Such the problems become remarkable under the low temperature and humidity condition.

SUMMARY

A toner for developing an electrostatic charge image comprising a resin, a colorant, and a particle having domain-matrix structure and the particle having two or more kinds of metal elements.

DETAIL EXPLANATION OF THE EXAMPLARY EMBODIMENTS

The embodiment of the toner is a toner containing at least a resin and a colorant, which further contains a particle A having a domain-matrix structure and having two or more kinds of metal elements.

The particle A has nature of being not released from the toner particle surface since the particle A is difficultly buried in the toner particle and is strongly fixed onto the toner particle surface.

It is confirmed that the releasing of metal oxide particles from the toner particle surface is considerably reduced by the use of the particle A having the domain-matrix structure or the particle A having the composition represented by Formula I.

Though the reason of such the effect is not cleared, it is supposed that an electric dipole is caused in the metal oxide by the distribution of the electric resistance and the permittivity which is constituted by the presence of the crystalline domain having low electric resistance and high permittivity dispersed in the amorphous matrix range. As a result of that, the electrostatic adhering force of the particle with the toner particle is raised and the metal oxide particle is difficultly released from the toner particle surface.

It is supposed that in the particle A having the composition of Formula I, the permittivity is varied because the metal oxide having low electric resistance is mixed with the inner structure of the internal additive. Consequently, the particle A is difficultly buried into the toner particle and difficultly moved from the toner surface to the carrier surface. Therefore, the charging amount of the developer is stably held even when the printing is repeatedly performed so that the occurrence of fogging can be inhibited. Moreover, the damage on the surface of the heating member is difficultly formed and the occurrence of the black spot caused by the damage can be easily inhibited since the external additive is difficultly moved from the toner surface to the surface of the heating member.

The detail description is as follows.

<<Particle A>>

(Particle A Having the Domain-Matrix Structure)

Figure 1:
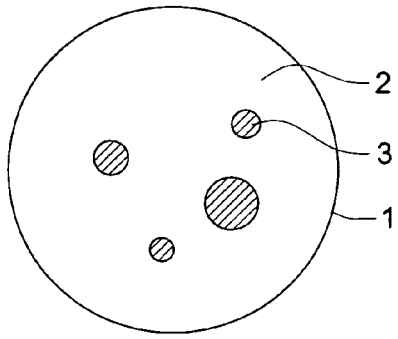
FIG. 1 shows a cross section of a particle (A) having a domain-matrix structure as an example.

The particle A having the domain-matrix structure is described referring FIG. 1.

FIG. 1 shows a cross section of the metal oxide particle having the domain-matrix structure.

In FIG. 1, 1 is the particle A, 2 is the matrix (also referred to as sea) as the continuous phase and 3 is the domain (also referred to as island).

The domain-matrix structure is also called as a sea-island structure in which an island-like phase having a closed interface (a boundary between two phases) is in a continuous phase (the continuous phase is the matrix or the sea).

Namely, the particle A has constituting components which are not dissolved with each other and each form independent phases, a domain (island) and a matrix (sea), so that one of the components forms the island-like phase and the other one of the component forms the sea-like phase and the domain-matrix structure (sea-island structure) is constituted.

(Confirmation of the Domain-Matrix Structure)

The domain-matrix structure of the particle A can be confirmed by observation of the particle and mapping of the subjective element by a field emission transmission electron microscope (FE-TEM).

(Amorphous Matrix and Crystalline Domain)

The particle A may be one in which the matrix is in an amorphous state and the domain is in a crystal state.

The detection of the crystal in the particle A can be measured by the phase difference mode of a high resolution transmission electron microscope.

<Measuring Method>

It is preferable that the particle A is sampled on a grid mesh on which a micro grid of carbon is provided and the transmission-image of the particle is observed by a transmission electron microscope (TEM), preferably the high resolution transmission electron microscope (HR-TEM) such as the field emission type transmission electron microscope (FE-TEM).

When the sample is a crystal, the electron ray passed through the sample is separated to transmitted wave and diffracted wave. A lattice image corresponding to the crystal of the sample can be observed by the observation on an interference image of the transmitted wave and the diffracted image. The phase contrast of the interference image is proportional to the amplitude of the diffraction, and therefore detectable contrast can be obtained even when the diffraction amount is small such as that caused by a single atom.

This method is applied for high resolution observation such as the lattice image. Regarding the observation method for the lattice image, S. Horiuchi "Koubunkainou Denshi Kenbikyou (High resolution electron microscope)" Kyouritsu Shuppan, 1988, can be referred.

<Measuring Condition>

A dispersion composed of purified water in which the particles A are dispersed is dropped on a grid mesh on which a microgrid is provided and dried to prepare a sample for observation.

The structure and the composition are evaluated by a 200 kV field emission type transmission electron microscope JEM-2010F manufactured by Nihon Denshi Co., Ltd. and an energy dispersive X-ray analyzer (DES) Voager manufactured by Thermo NORMAN Co., Ltd.

Conditions are set as follows.

Acceleration voltage: 200 kV

Observation magnitude of TEM image: 50,000 to 500,000

Measuring time of EDS (Live time): 50 seconds

Measuring energy range: 0 to 2,000 eV

<Measuring Results>

A particle having the matrix-domain structure in which the matrix contains silica and the domain contains titanium is described as an example. As a result of the observation on the particle by the FE-TEM under the above conditions, lattice images are observed in several places in the metal oxide particle. No lattice image is observed around the place where the lattice image is observed. Thus it is confirmed that the domains of crystal are in the amorphous matrix. Moreover, it is understood that the crystalline titania locally exists in the amorphous silica since Ti is detected at the crystalline domain and is not detected at the matrix by the point analysis by the EDS.

In such the case, the analysis is performed in an extreme fine area. Accordingly, the analysis is preferably carried out by TEM mode by which DES analysis can be performed while observing the lattice image.

The particle A may be contains two or more kinds of metal element. Examples of preferable metal element include Si, Ti, Mg, Al, Sn, Ge, Zr and Zn, and Si and Ti are more preferable.

It is preferable that the particle A is substantially constituted by metal oxide. The term of "substantially" means that the state in the particle does not apparently hinder the object of the addition of the metal oxide. Therefore, the particle is preferably constituted by 100% of metal oxide.

(Particle A Having the Composition of Formula 1)

The particle A can have the composition represented by Formula 1.

$$Si_{(1-X)}M_XO_{(2-2X+aX/2)} \quad \text{Formula 1}$$

In the formula, X is from 0.01 to 0.5, M is a mono-through tetra-valent metal element and a is a valent number of the metal element.

In the formula X is from 0.01 to 0.5, and more preferably from 0.05 to 0.4. When X is within the above range, the effect of the metal oxide is made suitable and the external additive is difficultly moved static electrically from the toner surface to the carrier surface or the heating member surface. Moreover, the charging amount of is made suitable since the electric resistance of the external additive is held at a suitable and the additive is difficultly released from the toner surface so that the external additive is difficultly moved electrostatically from the toner surface to the carrier surface or the heating member surface.

M is a mono- through tetra-valent metal element. Preferable metal element, for example, Ti, Mg, Al, Sn, Ge and Zn, and Ti is more preferable, even though the metal is not limited to the above.

"a" is the valent number of the metal element M.

Examples of particle of Formula 1 include $Si_{(1-X)}Ti_XO_{(2-2X+4X/2)}$, $Si_{(1-X)}Sn_XO_{(2-2X+4X/2)}$, $Si_{(1-X)}Mg_XO_{(2-2X+2X/2)}$, $Si_{(1-X)}Al_XO_{(2-2X+3X/2)}$, $Si_{(1-X)}Sn_XO_{(2-2X+4X/2)}$ and $Si_{(1-X)}Zn_XO_{(2-2X+2X/2)}$, even though the particle is not limited to the above. In the above, X is from 0.05 to 0.5 and X is measured by fluorescent X-ray analysis (WDX).

The particle A relating to Formula 1 may by one in which the matrix is amorphous and domain is crystallized portion, particularly the matrix may be a Si composition and the domain portion is an M composition.

The particle A relating to Formula 1 may be either one treated by a hydrophobic treatment or not. The hydrophobilizing treatment on the surface of the external additive is preferably a treatment by a coupling agent such as a titanium coupling agent and a silane coupling agent, and the treatment by a metal salt of higher fatty acid such as aluminum stearate, zinc stearate and calcium stearate is also preferred.

Hexamethyldisilazane is particularly preferred.

The number based average diameter of primary particles of the particle A is preferably from 10 to 1,000 nm, more preferably from 10 to 300 nm, further preferably from 35 to 180 nm and particularly preferably from 60 to 140 nm. The primary particles diameter of the Particle A is preferably from 10 to 1,000 nm, more preferable from 10 to 300 nm, further preferably from 35 to 180 nm and particularly preferably from 60 to 140 nm.

The number average primary particle diameter of the particle A relating to Formula 1 is preferably from 50 to 1,000 nm and more preferably from 50 to 500 nm.

The value of the number average primary particle diameter is arithmetic average of the Feret direction diameter of 100 particles enlarged by a magnitude of 20,000 times by the transmission electron microscope.

The Feret horizontal diameter of the domain is preferably from 1 to 60 nm, more preferably from 2 to 60 nm, and further preferably from 4 to 20 nm. Particularly, the domain is preferably from 1 to 60 nm, more preferably from 2 to 60 nm, and further preferably from 4 to 20 nm in the number based average Feret horizontal diameter.

The Feret horizontal diameter of the domain and the primary particle diameter of the particle A having the domain-matrix structure can be measured by the transmission electron microscope. On such the occasion, the values can also be obtained by the use of an image analyzing apparatus available on the market such as LUZEX F manufactured by Nihon Nicole Co., Ltd. The Feret horizontal diameter of the domain and the primary particle diameter of the particle A having the domain-matrix structure can be obtained by arithmetic average of the values obtained such the method.

The Feret horizontal diameter is the length in the horizontal direction of the particle put in an optional state, and the Feret horizontal diameter of the island is the length of the island in the metal oxide particle put in an optional state.

The producing method of the Particle A is described exemplifying the metal oxide.

The metal oxide particle can be produced by a flame combustion method or a wet method, and the flame combustion method is preferable.

Though there is no limitation on the basic production method by the flame combustion, a preferable method showing high reproducibility is a method in which a silane coupling agent containing no halogen is mixed with a metal coupling agent in a liquid state and sprayed into flame through a burner.

The diameter of the domain can be controlled by the amount of halogen contained in the raw material, and domain diameter is lowered accompanied with the increasing of the halogen. When amount of halogen is excessive, the phase separation does not occur and the domain-matrix structure is not formed. The amount of halogen is preferably from 0 to 4% by weight. Besides, the domain can be made crystalline or amorphous by controlling the temperature and the staying time in the flame on the occasion of the flame combustion. In general, crystals tend to be formed when the temperature of the flame combustion is high and the staying time is prolonged. In concrete, it is preferable that the flame temperature is made to not less than 1,700° C. and the staying time is made within the range of from 1.5 to 7 times of that for producing silica.

Figure 2:
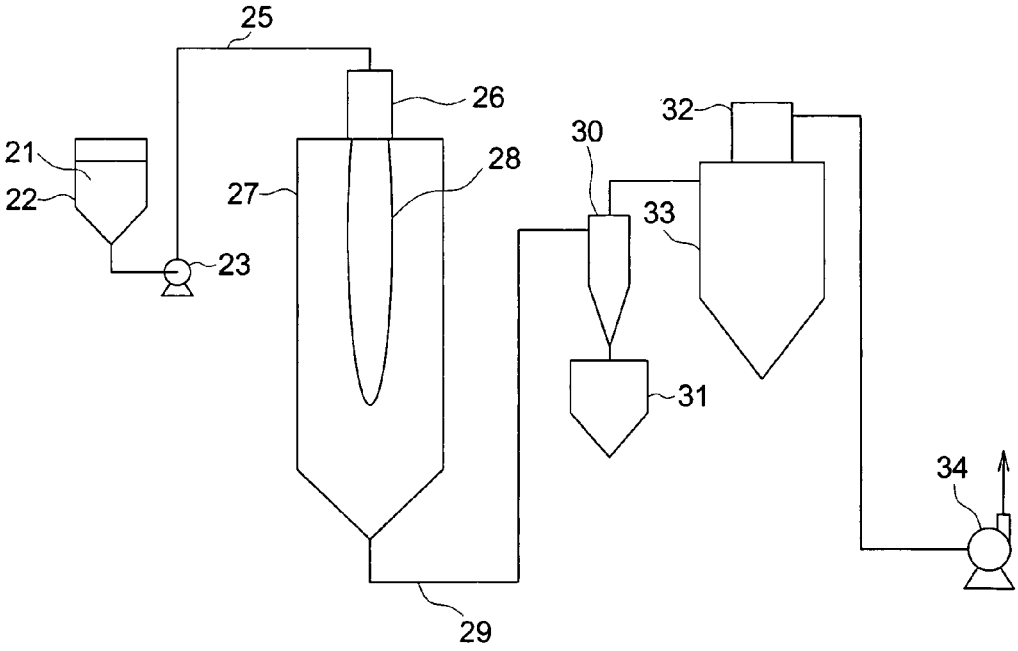
FIG. 2 shows a flow chart of an example of manufacturing apparatus for producing the particle A.

FIG. 2 is a flow chart of an example of production equipment for producing the metal oxide particles.

In FIG. 2, the raw material (metal coupling agents mixture) 21 is introduced to a main burner 26, on which a spray nozzle is provided at the top thereof, from a raw material tank 22 by a metering supply pump 23 through a introducing pipe 25 and sprayed. The raw material 21 is splayed into a combustion furnace 27 and ignited by subsidiary flame to form combustion flame 28. The metal oxide particles formed by combustion is cooled together with the exhaust gas in a smoke way 29 and separated by a cyclone 30 and a bag filter 33 and caught by recovering containers 31 and 33. The exhaust gas was evacuated by an exhausting fan 34 through 32.

The particle A relating to Formula 1 can be produced by combustion of a mixture of siloxane and a metal compound, but the production-method is not limited to such the method.

As the siloxane, for example, a silane compound, an alkoxysilane and an organosiloxane are employable. Concrete examples included silicon tetrachloride, tetramethoxysilane, hexamethyldisiloxane, octamethyltrisiloxane, octamethylcyclotetrasiloxane and decamethylcyclopentasiloxane, but the siloxane compounds are not limited to the above.

As the metal compound, a metal halide, a titanium coupling agent and an aluminum coupling agent are usable. In concrete, titanium tetrachloride, magnesium dichloride, aluminum trichloride, tin tetrachloride, germanium tetrachloride, zinc dichloride, tetrabutyltitanate, tetraoctyltitanate, isopropyltriisostearoyltitanate, isopropyltridecylbenzenesulfonyltitanate and bis(dioctylpyrophosphate)oxyacetatetitanate, but the compound is not limited to the above.

The X in Formula 1 is depending on the mixing ratio of the siloxane and the metal compound as the raw materials on the occasion of combustion. For obtaining the designated value of X, the mixing ratio of the siloxane and the metal compound is controlled so as to satisfy the object.

The number average primary particle diameter can be controlled by controlling the flame temperature, the concentration of the raw materials and the staying time in the flame.

It is preferable that the particles A are added in an amount of within the range of from 0.01 to 5 parts by weight to 100 parts by weight of the colored particles. When the adding amount is within the above range, the effect for constantly holding the charging amount is enhanced and the scattering of the toner causing the contamination in the apparatus tends to be inhibited.

<<Toner Particle>>

Though the resin and the colorant constituting the toner particle are later-described, the preferable feature of the toner particle is described here.

(Toner Particle without Corner>>

The toner particle is preferably one having the shape of "without corner" is preferred from the viewpoint of lowering the coagulation tendency.

The ratio of the toner particles without corner to the whole toner particles is preferably not less than 50%, more preferably from 60 to 95%, and further preferably from 65 to 85%, in number.

When the ratio of the toner particles without corner is not less than 50%, the fixing ability of the toner is improved and the offset difficultly occurs since the space in the transferred toner layer is reduced. As a result of that, the toner particles easily abraded or broken and the particles each having a portion where the charge is concentrated are reduced, and therefore the charge distribution is made sharp and the charging is stabilized so that high image quality can be obtained for long period.

The "toner particle without corner" is a toner particle which has substantially no corner where the charge is concentrated and is easily abraded by stress. In concrete, such the particle is defined as follows.

Figure 3:
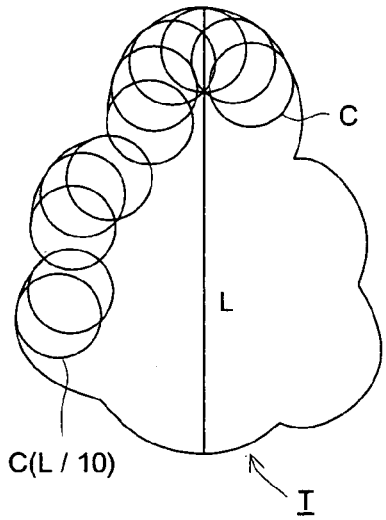
FIGS. 3(*a*) through 3(*c*) each show an example of toner particle having no corner.
Figure 3:
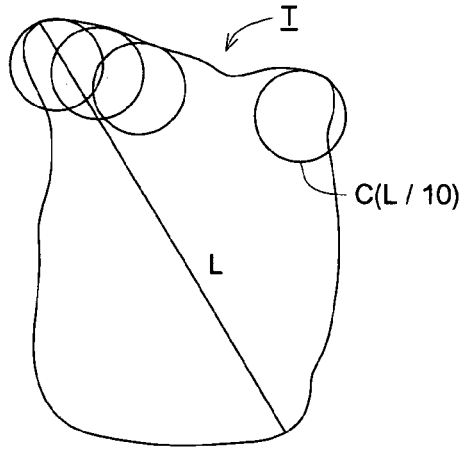
Figure 3:
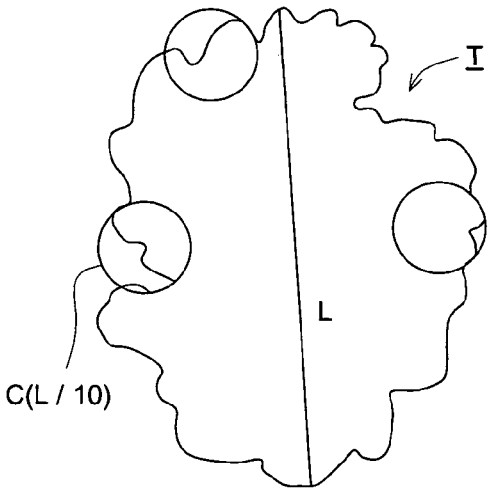

As is shown in FIG. 3*a*, the particle without corner is a toner particle T in which a circle C having a radius of L/10, L is the major diameter of the particle, is substantially not jutted out from the out line of the particle when the circle C is rolled on inside of the outline of the particle while contacting at one point to the outline. The term of "substantially not jutted out" means that the number of the corner where the circle C is jutted out is one or less. The "major diameter" is the width of the particle at which the distance of two parallel lines each circumscribing to the different sides of the image of the toner particle projected on a plane surface is become largest. FIGS. 3*b* and 3*c* each show projected images of toner particle with corner.

The ratio of the toner particles without corner is measured as follows. The toner particles are photographed by a scanning electron microscope, and the photograph is further enlarged to obtain a photographic image with a magnitude of 15,000. And then the presence of the corner was measured with respect to 100 toner particle on the photographic image.

The production method of the toner particle without corner is not specifically limited. In concrete, the following methods can be applied, a method in which the toner particles are sprayed into hot air stream, a method in which mechanical energy by shocking is repeatedly applied to the toner particles in a gas phase, and a method in which the toner particles are added into a solvent capable of not dissolving the toner particle and the resulted liquid is applied rotation flow.

(Number Variation Coefficient In Particle Size Number Distribution of Toner Particles)

It is preferable that the toner particles preferably has a number variation coefficient in the particle size number distribution of not more than 27%, more preferably from 9 to 25%, and further preferably from 12 to 21%. By the use of the toner particle having a number variation coefficient in the particle size number distribution of not more than 27%, the charging ability of the toner is stabilized and the occurrence of the insufficient cleaning is inhibited.

The number variation coefficient in the particle size number distribution which is a variable representing the uniformity of the shape of the toner particle can be measured by Coulter Counter TA or Coulter Multisizer, each manufactured by Coulter Co., Ltd. The measurement is carried out by the Coulter Multisizer which is connected to a personal computer through an inter face, manufactured by Nikkaki Co., Ltd., for outputting the particle size distribution. In the Coulter Multisizer, an aperture of 100 μm is employed, and the volume and the number of the toner particle of not less than 1 μm are measured to calculate the particle size distribution and the number average particle diameter. The particle size number distribution represents the relative frequency of the toner particle with respect to the particle diameter, and the number average particle diameter represents the median diameter in the particle size number distribution. The number variation coefficient in the particle size number distribution (hereinafter referred to as number variation coefficient of toner particles) is calculated by the following formula.

$$\text{Number variation coefficient of toner particles}=(S_2/D_n)\times 100(\%)$$

In the formula, $S_2$ is the standard deviation in the particle size distribution and $D_n$ is number average particle diameter (μm)

The number variation coefficient of toner particles can be controlled by known methods. For example, the classification in a liquid is effective for further decreasing the number variation coefficient even though the classification by wind also can be applied. As the classification method in the liquid, a method employing a centrifugal separator in which the rotating speed is controlled and toner particles are separated and recovered corresponding to the difference of the precipitation speed depending on the difference of the particle diameter.

When the toner particle is produced by a suspension polymerization method, the classification is essential to make the number variation coefficient in the particle size number distribution to not more than 27%. In the suspension polymerization method, it is necessary to disperse the polymerizable monomer into a state of oil droplet having a size desired for the toner particle in an aqueous medium. For such the purpose, a large droplet of the polymerizable monomer is repeatedly subjected to mechanical sharing to make fine the oil droplet near the size of the toner particle. The particle size number distribution of the oil droplets is made wide by such the mechanical sharing method so that the particle size distribution of the toner produced by the polymerization of such the droplets is also wide. Therefore, the classification operation is preferably applied.

The toner particle may be capsulated by a resin composition different from each other or decorated on the surface.

The capsulation and the decoration are defined as follows. The capsulated particle is a particle in which the hardness or the viscoelasticity of the inner portion of the particle and those of the surface of the particle are different from each other when the viscoelasticity image of the cross section of the toner particle measured by using a scanning atomic force microscope. When the hardness or the viscoelastic behavior of the surface is locally different, such the particle is defined as the decorated particle.

The capsulated or the decorated toner particle can be produced by totally covering (capsulation) or partially covering (decoration) the toner particle by a resin having a glass transition point Tg higher than that of the resin of inside of the particle.

The toner can be produced by known method without any limitation.

A method is described below in which a resin particle is prepared in the presence of no colorant, a dispersion of colorant particles is added to the dispersion of the above resin particles and then the resin particles and the colorant particles are slated out, coagulated and fused to form the toner particle.

According to the above method, the polymerization reaction for obtaining the resin particle is not hindered since the preparation of the resin particle is carried out in the present of no colorant. Therefore, an image excellent in the anti-offset property can be formed and the contamination of the fixing device and that on the image caused by the accumulation of the toner when the image formation is carried out by such the toner.

Consequently the polymerization reaction is surely carried out, any monomer or oligomer does not remain in the resin particles and therefore bad odor is not generated from the thermal fixing device even when many sheets of print are formed.

The surface property of thus prepared toner is uniform and the charge distribution is sharp. Therefore, an image excellent in the sharpness can be formed for a long period.

The resin particle constituting the toner particle is preferably a particle having a multi layered structure which is constituted by a resin core and one or more resin layers composed of resins different from the core resin in the molecular weight and/or composition.

It is preferable-that the molecular weight distribution in the resin particle is not uniform and the resin particle has a tangent of molecular weight between from the central portion (core) to the outer layer (shell).

A multi-step polymerization is preferably applied for obtaining the resin particle from the view point of controlling of the molecular weight distribution for holding the fixing strength and the anti-offset property. The multi-step polymerization method is a method in which a resin particle (n) is prepared by polymerization (step n) of a monomer (n) and a covering layer (n+1) composed of a polymer of a monomer (n+1) is formed by polymerization (step n+1) of the monomer (n+1) in the presence of the resin particle (n) on the surface of the resin particle, the resin of the resin particle (n) and the polymer of the monomer (n+1) are different from each other in the dispersed state and/or the composition.

When the resin particle (n) is a core particle (n=1), the polymerization process is referred to as a double-step polymerization method, and when the resin particle (n) is a composite resin particle (n+2), the polymerization process is triple or more multi-steps polymerization method.

Plural kinds of resins each different from each other in the composition and/or molecular weight exist in the composite resin particle obtained by the multi-step polymerization method. Accordingly, the fluctuation in the composition, molecular weight and surface property between the every individual toner particles is extremely small in the toner produced by salt out, coagulation and fusion of the composite and colorant particle.

By such the toner in which the composition, molecular weight and the surface property are uniform, the anti-offset ability and the anti-winding property can be improved while maintaining the suitable adhesiveness of the toner to the image support (high fixing strength) and a image having suitable glossiness in the image forming method including the fixing process by the contact heating system.

A concrete example of the producing method of the toner is constituted by the following processes: (1) a polymerization process for obtaining the resin particles; (2) a salt out, coagulation and fusion process (II) for obtaining the toner particles by salting out, coagulating and fusing the resin particles and the colorant particles, (3) a filtration and washing process for separating the toner particles from the dispersion thereof and removing a surfactant from the surface of the toner particles, (4) a drying process for drying the washed toner particles, and (5) a process for adding an external additive to the dried toner particles.

The processes are described below.

A parting agent can be included in the resin particle (core particle) by a method in which the parting agent is dissolved in the monomer and the resulted monomer solution was dispersed into a state of oil droplet in an aqueous medium, and then the system is subjected to a polymerization treatment to obtain as latex particles.

The salt out, coagulation and fusion process (II) is a process in which the resin particles prepared by the polymerization process (I) are salted out, coagulated and fused with the colorant particles (salting out and fusing are simultaneously progressed) to obtain non-spherical toner particles.

In the salt out, coagulation and fusion process (II), internal additive particles (fine particles having a number average primary particle diameter of approximately from 10 to 1,000 nm), for example, the parting agent such as an ester wax and a charge controlling agent may be added together with the composite resin particles and the colorant particles to be salted out, coagulated and fused.

The colorant particle may be modified on the surface thereof. As the surface modifying agent, known ones can be employed.

The colorant particles are subjected to the salt out, coagulation and fusion treatment in a state of dispersion in an aqueous medium. An aqueous solution in which a surfactant is dissolved in a concentration of not less than the critical micelle concentration is usable for the aqueous medium for dispersing the colorant particles.

The surfactant the same as that employed in the multi-step polymerization process (I) can be used for the colorant dispersion.

Though the dispersing apparatus to be used for dispersing the colorant particles is not specifically limited, for example a stirring apparatus having a high speed rotor CLEAMIX (CLEARMIX), manufactured by M-Technique Co., Ltd., a ultrasonic disperser, a mechanical homogenizer, a pressing disperser such as Manton-Goulin homogenizer and a pressing homogenizer, and a medium disperser such as Getzman mill and a diamond fine mill are employable.

It is preferable for salting out, coagulating and fusing the resin particles with the colorant particles that a coagulating agent is added to the dispersion in which the resin particles and the colorant particles are dispersed so that the concentration of the coagulating agent is higher than the critical coagulation concentration while heating the dispersion so that the temperature of the dispersion is higher than the glass transition point Tg of the resin particle.

It is more preferable to employ a coagulation stopping agent at the time when the particle diameter of the composite resin particle is come up to the desired value by the coagulating agent. As the coagulation stopping agent, a mono-valent metal salt, particularly sodium chloride, is preferably employed.

The temperature range suitable for the salt out, coagulation and fusion is from (Tg+10) to (Tg+50)° C. and particularly preferably from (Tg+15) to (Tg+40)° C. A water-permissible organic solvent may be added for effectively carrying out the fusion.

The foregoing alkali metal salts and alkali-earth metal salts are employable as the coagulating agent to be employed on the occasion of the salt out, coagulation and fusion.

The salt out and coagulation are described below.

The "salt out, coagulation and fusion" means the phenomenon of that the salt out (coagulation of the particles) and the fusion (disappearance of the interface of the particles) are simultaneously progressed or an action for simultaneously progressing the salt out and the fusion.

It is preferred for simultaneously carrying out the salt out and the fusion that the particles (the composite resin particles and the colorant particles) are coagulated at a temperature higher than the glass transition point Tg of the resins constituting the composite resin particles.

The polymerization reaction for forming the composite resin particle is not hindered when the preparation of the resin particle is performed in the presence of no colorant. Therefore, the anti-offset property of the toner produced by such the method is not degraded and the contamination of the fixing device and the image by the accumulation of the toner is not caused.

As a result of that the polymerization reaction is surely carried out, any monomer or oligomer does not remained in the resin particles and therefore bad odor is not generated from the thermal fixing device in the thermal fixing process of the image forming method employing such the toner.

The surface property of the toner particles is uniform and the charging amount distribution is sharp. Consequently, images excellent in the sharpness can be obtained for a long period. By such the toner in which the composition, molecular weight and surface property of each of the particles are uniform, the anti-offset property can be improved while maintaining good adhesiveness (high fixing strength) to the image support, and an image suitable glossiness can be obtained.

For example, thermoplastic resin is employed for forming the foregoing resin particle. Concrete examples of the resin include a homo- or co-polymer of a styrene (styrene type resin) such as α-styrene; a homo- or co-polymer of an ester having a vinyl group (vinyl type resin) such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate; a homo- or co-polymer of a vinylnitrile (vinyl type resin) such as acrylonitrile and methacrylonitrile; a homo- or co-polymer of a vinyl ether (vinyl type resin) such as vinyl methyl ether and vinyl isobutyl ether; a homo- or co-polymer of a vinyl ketone (vinyl type resin) such as vinyl methyl ketone, vinyl ethyl ketone and vinyl isopropenyl ketone; a homo- or co-polymer of an olefin (olefin type resin) such as ethylene, propylene, butadiene and isoprene; a non-vinyl condensate resin such as epoxy resin, polyester resin, polyurethane resin, polyamide resin, cellulose resin and polyether resin; and a graft polymer of the non-vinyl condensate resin and a vinyl type monomer. These resins may be employed singly or in combination of two or more kinds.

Among the above resins, the vinyl type resins are particularly preferred. The vinyl type resins are advantageous on the point that the resin particle dispersion can be easily formed by emulsion polymerization or seed polymerization using the surfactant. Examples of the vinyl type monomer include monomers capable of being the raw material of a vinyl type polymerizable acid or a vinyl type polymerizable base such as acrylic acid, methacrylic acid, maleic acid, cinnamic acid, fumalic acid, vinylsulfonic acid, ethyleneimine, vinylpyridine and vinylamine. It is preferable that the resin particle contains the above vinyl type monomer as the monomer composition. Among these vinyl type monomers, the vinyl type polymerizable acids are preferable in respect of easiness of the vinyl type resin forming reaction. In concrete, dissociative vinyl type monomers such as acrylic acid, methacrylic acid, maleic acid, cinnamic acid and fumalic acid each having a carboxyl group as the dissociative group are particularly preferred from the viewpoint of the control of the polymerization degree and the glass transition point.

The concentration of the dissociative group in the dissociative vinyl type monomer can be determined by a method by dissolving the toner particle from the surface thereof such as that described in "Kobunshi Latex no Kagaku (Chemistry of polymer latex)", Kobunshi Kanko Kai. By such the method, the molecular weight and the glass transition point of the resin from the surface to the interior of the particle can be determined.

The number average diameter of the resin particles is usually at most 1 μm (not more than 1 μm) and preferably from 0.01 to 1 μm. When the number average particle diameter exceeds 1 μm, the distribution of the diameter of the finally obtained toner particles is made wider and free particles are formed so that the properties and the reliance tend to be lowered. When the number average particle diameter is within the above range, the drawbacks are not caused and merits such as that the uneven distribution of the resin particle between the toner particles, the dispersion in the toner particle is improved and the scattering of the properties and the reliance are reduced. The number average particle diameter can be measured by, for example, Coulter Counter.

The colorant dispersion is at least comprised of a dispersed colorant. Examples of the colorant include various kinds of pigment such as carbon black, chrome yellow, Hansa yellow, benzidine yellow, thren yellow, quinoline yellow, Permanent Orange GTR, pyrazolone orange, Vulcan Orange, Watchung Red, Permanent Red, Brilliant Carmine 3B, Brilliant Carmine 6B, du Pont Oil Red, pyrazolone red, Lithol Red, Rhodamine B Lake, Lake Red C, Rose Bengal, aniline blue, ultramarine blue, carkoil blue, methylene blue chloride, phthalocyanine blue, phthalocyanine green and malachite green oxalate; a various kinds of dye such as those of an acrydine type, a xanthene type, an azo type, a benzoquinone type, an azine type, an anthraquinone type, a dioxazine type, a thiazine type, an azomethine type, an indigo type, a thioindigo type, a phthalocyanine type, an aniline black type, a polymethine type, a triphenylmethane type, a diphenylmethane type, a thiazine type, a thiazole type and a xanthene type. These colorants may be employed singly or in combination of two or more kinds.

The number average particle diameter of the colorant is usually at most 1 μm (not more than 1 μm), preferably at most 0.5 μm (not more than 0.5 μm), and particularly from 0.01 to 0.5 μm. When the number average particle diameter is within the above range, the drawback are not caused and merits such as that the uneven distribution of the resin particle between the toner particles, the dispersion state in the toner particle is improved and the scattering of the properties and the reliance are reduced. Moreover, the number average particle diameter of 0.5. μm brings merits such as that the toner excellent in the coloring ability, color reproducibility and the transparency of the OHP film. The number average particle diameter can be measured by, for example, a micro truck.

It is preferable to contain a parting agent in the toner particle.

A known compound and a compound represented by the following formula are employable as the parting agent, and the compounds represented by the following formula are preferred.

$$R^1—(OCO—R^2) \qquad \text{Formula}$$

In the above, n is an integer of from 1 to 4, preferably 3 or 4, and particularly preferably 4.

$R^1$ and $R^2$ are each a hydrocarbon group which may have a substituent.

Number of the carbon atoms in $R^1$ is preferably from 1 to 40, more preferably from 1 to 20, and particularly preferably from 2 to 5.

Number of the carbon atoms in $R^2$ is preferably from 1 to 40, more preferably 16 to 30, and particularly preferably from 18 to 26.

Examples of typical compounds are shown below.

1)

$$CH_3—(CH_2)_{12}—COO—(CH_2)_{17}—CH_3$$

2)

$$CH_3—(CH_2)_{18}—COO—(CH_2)_{17}—CH_3$$

3)

$$CH_3—(CH_2)_{20}—COO—(CH_2)_{21}—CH_3$$

4)

$$CH_3—(CH_2)_{14}—COO—(CH_2)_{19}—CH_3$$

5)

$$CH_3—(CH_2)_{20}—COO—(CH_2)_6—O—CO—(CH_2)_{20}—CH_3$$

6)

$$CH_3—(CH_2)_{20}—COO—(CH_2)_2—\underset{}{\overset{CH_3}{\overset{|}{CH}}}—CH_2—O—CO—(CH_2)_{20}—CH_3$$

7)

$$CH_3—(CH_2)_{22}—COO—(CH_2)_2—\overset{CH_3}{\overset{|}{CH}}—CH_2—O—CO—(CH_2)_{22}—CH_3$$

8)

$$CH_3—(CH_2)_{22}—COO—CH_2—\underset{CH_3}{\overset{CH_3}{C}}—CH_2—O—CO—(CH_2)_{22}—CH_3$$

9)

$$CH_3—(CH_2)_{26}—COO—CH_2—\underset{CH_3}{\overset{CH_3}{C}}—CH_2—O—CO—(CH_2)_{26}—CH_3$$

10)

$$\begin{array}{l} CH_2—O—CO—(CH_2)_{26}—CH_3 \\ | \\ CH—O—CO—(CH_2)_{26}—CH_3 \\ | \\ CH_2—O—CO—(CH_2)_{26}—CH_3 \end{array}$$

11)

$$\begin{array}{l} CH_2—O—CO—(CH_2)_{22}—CH_3 \\ | \\ CH—O—CO—(CH_2)_{22}—CH_3 \\ | \\ CH_2—O—CO—(CH_2)_{22}—CH_3 \end{array}$$

12)

$$\begin{array}{l} CH_2—OH \\ | \\ CH—O—CO—(CH_2)_{26}—CH_3 \\ | \\ CH_2—O—CO—(CH_2)_{26}—CH_3 \end{array}$$

13)

$$\begin{array}{l} CH_2—OH \\ | \\ CH—O—CO—(CH_2)_{22}—CH_3 \\ | \\ CH_2—O—CO—(CH_2)_{22}—CH_3 \end{array}$$

14)

$$\begin{array}{l} CH_2—OH \\ | \\ CH—OH \\ | \\ CH_2—O—CO—(CH_2)_{26}—CH_3 \end{array}$$

15)

$$\begin{array}{l} CH_2—OH \\ | \\ CH—OH \\ | \\ CH_2—O—CO—(CH_2)_{22}—CH_3 \end{array}$$

16)

$$CH_3—(CH_2)_{26}—COO—CH_2—\underset{CH_2—O—CO—(CH_2)_{26}—CH_3}{\overset{CH_3}{C}}—CH_2—O—CO—(CH_2)_{26}—CH_3$$

-continued

17)

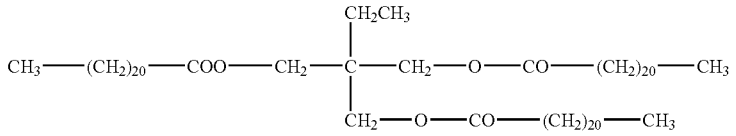

18)

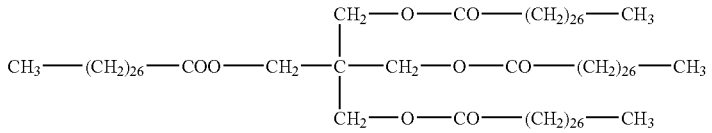

19)

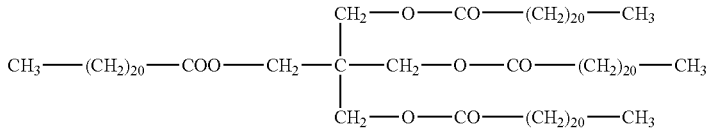

20)

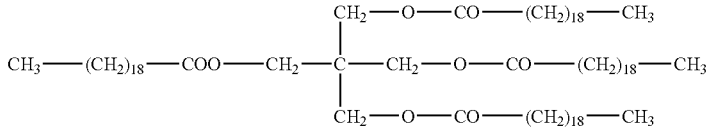

21)

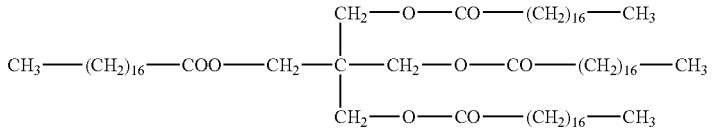

The adding amount of the parting agent is preferably from 1 to 30%, and more preferably from 3 to 25%, by weight of the whole toner particle.

A charge controlling agent may be further contained in the toner particle.

For example, a quaternary ammonium chloride compound, a nigrosine type compound and a dye composed of complex of metal such as aluminum, iron or chromium are employable as the charge controlling agent.

<<Preparation of Toner>>

The toner can be prepared by mixing the toner particle with an external additive such as a metal oxide particle. Various mixing apparatus such as a tabular mixer, a Henschel mixer, a tauner mixer and a V-type mixer can be employer even though the mixing apparatus is not specifically limited. Among them Henschel mixer is preferable.

The amount of the external additive to be added to the toner particles is preferably from 0.1 to 4%, and more preferably from 0.5 to 2%, by weight of the toner.

A known external additive other than the particle A may be added together with the particle A.

As the known external additive, a fine particle of titania or alumina each having a specific surface area measured by nitrogen absorption according to BET method of from 50 to 400 $m^2/g$ and an organic fine particle can be employed.

Examples of titania fine particle are T-805 and T-604 each manufactured by Nihon Aerogel Co., Ltd., MT-100S, MT-100B, MT-500BS., MT-600, MT-600SS and JA-1 each manufactured by Teika Co., Ltd., TA-300SI, TA-500, TAF-130, TAF-510 and TAF-510T each manufactured by Fuji Titan Co., Ltd., and IT-S, IT-OA, IT-OB and IT-OC each manufactured by Idemistu Kosan Co., Ltd. The above products are available on the market.

Examples of the alumina fine particle are RFY-C and C-604 each manufactured by Nihon Aerogel Co., Ltd., and TTO-55 manufactured by Ishihara Sangyo Co., Ltd. The above products are available on the market.

A spherical organic particle having a number average primary particle diameter of approximately from 10 to 2,000 nm can be used as the organic fine particle. A homo- or co-polymer of styrene and methyl methacrylate can be used as the material of the organic fine particle.

The toner may contain a slipping agent as the external additive. For example, a metal salt of higher fatty acid such as stearate of zinc, aluminum, copper, magnesium or calcium; oleate of zinc, manganese, iron, copper or magnesium; palmitate of zinc, copper, magnesium or calcium; linolate of zinc or calcium; and ricinolate of zinc or calcium are employable, even though the slipping agent is not limited to the above examples.

<<Developer>>

The toner can be employed as a single-component developer and a double-component developer, and the use as the double component developer is preferable.

When the toner is used as the single-component developer, the toner is usually employed in a form of a magnetic developer in which the toner particle contains a magnetic particle having a diameter of approximately from 0.1 to 5 μm, even though a method is applied in which the intact toner is employed. The magnetic particle is usually contained into the toner particle by a manner the same as that for the colorant particle.

When the toner is employed as the double-component developer by mixing with a carrier composed of magnetic particles, known metals such as iron, ferrite and magnetite and alloys of the metals with another metal such as aluminum and lead are employable. Among them the ferrite particle is particularly preferred. The volume average particle diameter of the carrier is preferably from 15 to 100 μm, and more preferably from 25 to 60 μm.

The volume average particle diameter (D4) can be typically measured by a laser diffraction particle size distribution measuring apparatus HELOS manufactured by Sympatic Co., Ltd., which has a wet type dispersing device.

A carrier in which the magnetic particle is coated with a resin and a resin dispersed type carrier in which the magnetic particle is dispersed in a resin can be employed. Olefin type resins, styrene type resins, styrene/acryl type resins, silicone resins, ester type resins and fluorine-containing polymer resins are employed as the coating resin even though the resin is not specifically limited. Known resins can be employed for constituting the resin dispersed type carrier without any limitation. For example, styrene/acryl resins, polyester type resins, fluorinated type resins and phenol type resins are usable.

The image forming method is described below.

<<Image Forming Method>>

The toner can be applied to an image forming method which has a process for forming a toner image on an image forming support (photoreceptor) and a process for fixing the toner image onto an image forming support by passing the toner image between a heating member (heating roller) and a pressing member (pressing roller).

Figure 4:
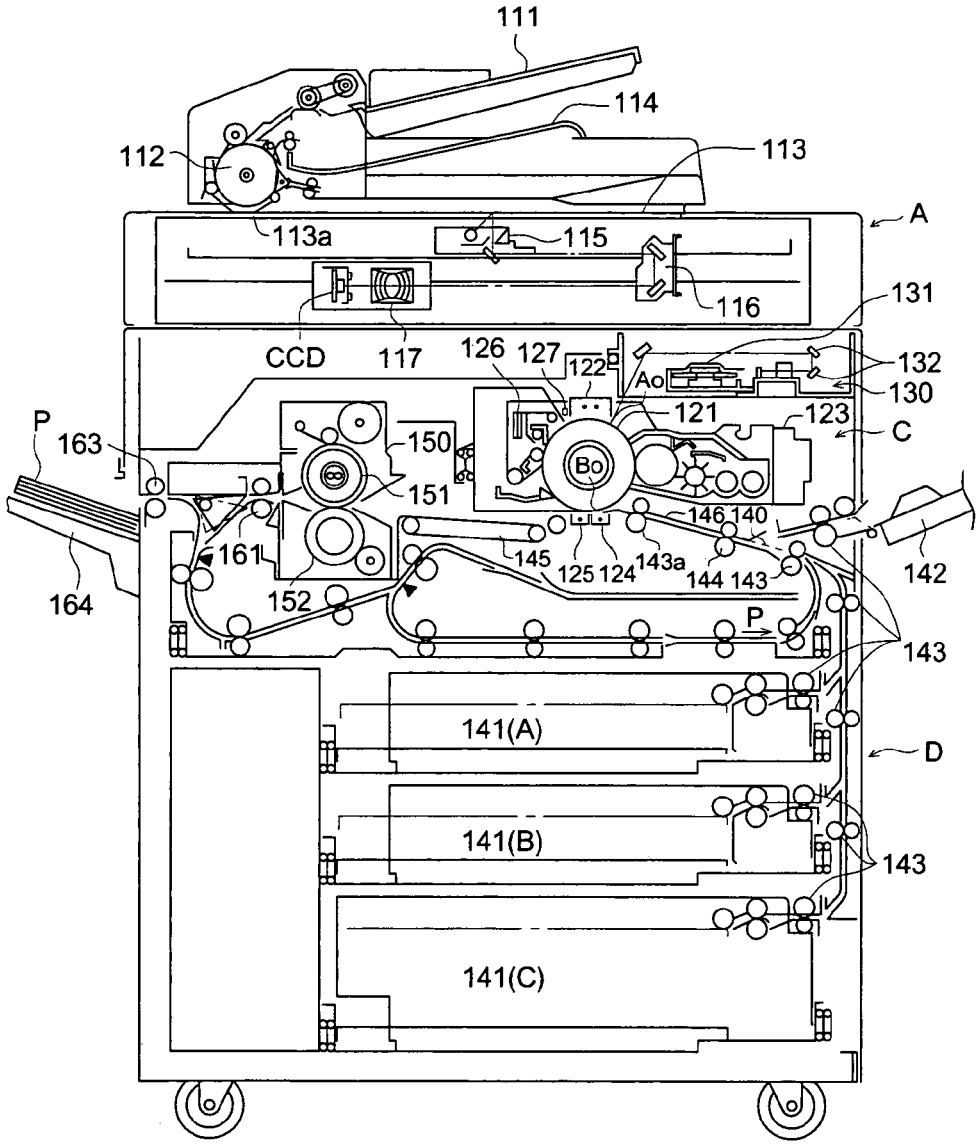
FIG. 4 shows a cross section of an image forming apparatus as an example of image forming method.

FIG. 4 shows a cross section of an image forming apparatus displaying an example of the image forming method.

The image forming apparatus shown in FIG. 4 is an image forming apparatus by a digital system which is constituted by an image reading section A, an image processing section B (not shown in the drawing), an image forming section C, an image receiving paper conveying section D as an image receiving paper conveying means.

An automatic original conveying means for automatically conveying the original image sheet is provided at the upper portion of the image reading section A, and original image sheets stood on an original image sheet standing stand 111 are conveyed one by one by an original image sheet conveying roller 112 and the image is read out at a reading position 113*a*. The original image sheet is output onto an original image sheet output tray 114 by the original image sheet conveying roller 112 after completion of the reading out.

The original image put on a platen glass 113 is read out by the reading action at a rate of v of a first mirror unit 115 constituted by a lighting lump and a first mirror and the movement at a rate of v/2 of a second mirror unit 116 constituted by a second mirror and a third mirror.

The read image is focused through a corner lens 117 on the light receiving face of imaging element CCD as a line sensor. The line-shaped optical image focused on the imaging element CCD is converted to sequence electric signal (luminance signal) and subjected to A/D conversion. Converted signal is subjected to treatments of density conversion and filtering and temporarily stored in a memory.

In the image forming section C, an image forming unit is constituted by a drum-shaped photoreceptor as an image carrier (hereinafter referred to as photoreceptor drum) 121, and a charging device 122 as a charging means, a developing device 123 as a developing means, a transfer device 124 as a transferring means, a separation device 125 as a separating means, a cleaning device (blade cleaning) 126 and a pre-charging lump PCL 127 are each arranged around the photoreceptor in the order of the action.

The photoreceptor 121 is comprised of a drum substrate and a photoelectric conductive compound coated on the substrate and driven so as to rotate in the clockwise direction as shown in the drawing, an organic photosensitive substance (OPC) is preferably employed as the photoelectric conductive compound. Regarding the toner according to the invention, it is preferable that the cleaning and development are simultaneously performed by the developing device 123 without the use of the cleaning device 126.

The rotating photoreceptor 121 is uniform ly charged by the charging device 122 and subjected to imagewise expose by the optical system for exposure 130 according to the image information called up from the image processing section B. In the optical system for exposure 130 as the writing means, the main scanning is performed by light beam which is generated form a light source of a laser diode (not shown in the drawing), and passed through a rotating polygon mirror 131, a fθ lens (with no sign), and cylindrical lens (with no sign), and reflected by a reflection mirror 132. The photoreceptor 121 is imagewise exposed at a position AO, and the formation of a latent image is carried out by the rotation of the photoreceptor 121 (sub-scanning).

The latent image formed on the photoreceptor 121 is reversely developed by the developing device 123 so that a visible toner image is formed on the surface of the photoreceptor 121. In the image receiving paper conveying section D, paper supplying units 141A, 141B and 141C are provided at the under side of the image forming unit as image receiving paper stocking means in each of which various sizes of image receiving paper P are stocked. Moreover, a paper supplying unit 142 for hand insertion is provided at the side. The image receiving paper P selected from one of the paper supplying unit is supplied along the conveying rout 140 by a guide roller 143. The image receiving paper P is stopped once by a pair of register rollers 143 by which the lean and partiality of the paper is corrected, and then further conveyed along a conveying route 140 and guided by a roller before transferring 143*a* and a guide plate 146 for introducing the paper to a transferring position $B_0$. At the position $B_0$, the toner image on the photoreceptor 121 is transferred onto the image receiving paper P, and then the image receiving paper is discharged by a separating device 125 and separated from the surface of the photoreceptor 121 and conveyed to a fixing device 150 by a conveying device 145.

The fixing device 150 has a heating roller 151 and a pressing roller 152 and the toner is fused and adhered to the paper P by passing the paper between the heating roller 152 and the pressing roller 152. After completion of the fixing, the image receiving paper is output on a paper outputting tray 164 by rollers 161 and 163.

The above apparatus can be applied either for a monocolor image formation or a full-color image formation. In the full-color formation, for example, a constitution in which a plurality of photoreceptor is provided and one or more developing devices are arranged around each of the photoreceptor, a constitution such as shown in FIG. 4 in which a plurality of developing device are arranged around a photoreceptor, and a constitution having a process in which a toner image formed on the photoreceptor is once transferred on an intermediate transferring member and further transferred onto a recording medium can be applied.

EXAMPLES

The invention is concretely described below referring examples. The embodiment of the invention is not limited to the examples.

<Part 1>

Example 1

<<Preparation of Metal Oxide Particle>>

The equipment shown in FIG. 2 was applied for the production of the metal oxide particle.

A raw material liquid prepared by mixing the raw materials listed in Table 1 was supplied to a burner provided at the top of a vertical combustion furnace, sprayed into fine liquid droplets by air as a spraying medium from a splaying nozzle provided at the end portion of the burner and combusted by an assistant flame by burning of propane. Oxygen or air was supplied through burner as a combustion holding gas.

Metal oxide Particles 1 through 9 were produced under the condition in which the supplying amounts of the raw material liquid, the spraying air, the propane and the oxygen and air were each controlled from 5 to 8 kg/hour, from 1 to 7 $Nm^3$/hour, 0.4 $N/m^3$ and from 15 to 184 $Nm^3$/hour, respectively, and the flame temperature was 2,500° C. Metal Oxide Particle 10 was produced in the same manner as the above-described except that the flame temperature was changed from 2,500° C. to 1,500° C. The product was recovered by a cyclone and a bag filter. Hexamethyldisilane was sprayed to thus obtain metal oxide particles.

The existence of the domain-matrix structure in the above-obtained metal oxide particle, the average primary particle diameter of the particles and the average Feret horizontal diameter of the domain based on the number were observed by a transmission electron microscope and measured by an image analyzing apparatus LUZEX F manufactured by Nireco Co., Ltd.

The crystal in the matrix and the domain was measured by the foregoing measuring method.

The raw materials employed for production of the metal oxide particle and the physical properties of the metal oxide particles were each listed Table 1 and Table 2, respectively.

TABLE 1

| | Raw material 1 | | Raw material 2 | | Raw material 3 | |
|---|---|---|---|---|---|---|
| Metal oxide particle No. | Material | Mixing ratio (Part by weight) | Material | Mixing ratio (Part by weight) | Material | Mixing ratio (Part by weight) |
| 1 | Compound 1 | 72 | γ-glycidoxypropyl-trimethoxysilane | 14 | Compound A | 14 |
| 2 | Compound 1 | 72 | γ-aminopropyl-trimethoxysilane | 15 | Compound B | 13 |
| 3 | Compound 1 | 72 | N-phenyl-γ-aminopropyl-trimethoxysilane | 12 | Compound C | 16 |
| 4 | Compound 1 | 84 | Titanium tetrachloride | 1 | Compound A | 15 |
| 5 | Compound 1 | 30 | γ-glycidoxypropyl-trimethoxysilane | 14 | Compound A | 56 |
| 6 | Compound 1 | 94 | Titanium tetrachloride | 2 | Compound A | 4 |
| 7 | Compound 1 | 20 | γ-glycidoxypropyl-trimethoxysilane | 24 | Compound A | 56 |
| Comparative 8 | Compound 2 | 100 | — | 0 | — | 0 |
| Comparative 9 | — | 0 | — | 0 | Titanium tetrarchloride | 100 |
| Comparative 10 | Compound 1 | 72 | γ-glycidoxypropyl-trimethoxysilane | 14 | Compound A | 14 |

Compound 1: Hexamethyldisiloxane

Compound 2: γ-chloropropyltrimethoxysilane

Compound A: Triisostearylisopropyl titanate

Compound B: Neoalkoxytrisneodecanoyl zirconate

Compound C: Acetoalkoxyaluminum diisopropilate

TABLE 2

| Metal oxide particle | Existence of domain-matrix structure | Physical properties of metal oxide particle: Structure: Matrix | Structure: Domain | Composition: Matrix | Composition: Domain | Number based average primary particle diameter (nm) | Number based average fere horizontal diameter of domain (nm) |
|---|---|---|---|---|---|---|---|
| 1 | Yes | Amorphous | Crystalline | Si | $TiO_2$ | 87 | 11 |
| 2 | Yes | Amorphous | Crystalline | Si | $ZrO_2$ | 105 | 15 |
| 3 | Yes | Amorphous | Crystalline | Si | $AlO_3$ | 58 | 6 |
| 4 | Yes | Amorphous | Crystalline | Si | $TiO_2$ | 41.4 | 2.1 |
| 5 | Yes | Amorphous | Crystalline | Si | $TiO_2$ | 154 | 28.7 |
| 6 | Yes | Amorphous | Crystalline | Si | $TiO_2$ | 24.4 | 1.2 |
| 7 | Yes | Amorphous | Crystalline | Si | $TiO_2$ | 287 | 58.6 |
| Comparative 8 | No | — | — | Si | — | — | — |
| Comparative 9 | No | — | — | Ti | — | — | — |
| Comparative 10 | Yes | Amorphous | Amorphous | Si | $TiO_2$ | 90 | 13 |

Example 2

<<Preparation of Toner 1>>

(Preparation of Latex (1HML))

(1) Preparation of Core Particle (the First Step Polymerization):

In a 5000 ml flask, to which a stirrer, temperature sensor, cooler tube and nitrogen gas introducing device were attached, a surfactant solution composed 7.08 parts by weight of Surfactant 101 dissolved in 3010 parts by weight of deionized water was charged and the temperature in the flask was raised by 80° C. while stirring at a speed of 230 rpm under a nitrogen gas stream.

Surfactant 101: $C_{10}H_{21}(OCH_2CH_2)_2OSO_3Na$

To the surfactant solution, an initiator solution composed of 9.2 parts by weight of a polymerization initiator (potassium per sulfate: KPS) dissolved in 200 parts by weight of deionized water was added and the temperature was adjusted to 75° C. After that, a monomer mixture liquid composed of 70.1 parts by weight of styrene, 19.9 parts by weight of n-butyl acrylate and 10.9 parts by weight of methacrylic acid is dropped to the solution spending 1 hour. Then the system was heated and stirred for 2 hours at 75° C. to perform polymerization (the first step polymerization) for forming latex (a dispersion composed of resin particles having high molecular weight). Resulted latex was referred to as Latex 1H.

(2) Formation of Intermediate Layer (the Second Step Polymerization):

In a flask to which a stirrer is attached, 98.0 parts by weight of the compound represented by Formula 19, hereinafter referred to as Exemplified Compound 19, as a crystalline substance was added to a monomer mixture liquid composed of 105.6 parts by weight of styrene, 30.0 parts by weight of n-butyl acrylate, 6.2 parts by weight of methacrylic acid and 5.6 parts by weight of n-octyl-3-mercaptopropionic acid ester and dissolved by heating by 90° C. to prepare a monomer solution.

On the other hand, a surfactant solution composed of 2,700 ml of deionized water and 1.6 parts by weight of anionic surfactant of Formula 101 dissolved in the water was heated by 98° C., and 28 parts by weight in terms of solid ingredient of Latex 1H as the dispersion of the core particles was added to the surfactant solution. After that, the foregoing monomer solution of Exemplified Compound 19 was mixed and dispersed for 8 hours by a mechanical dispersing apparatus CLEAMIX(CLEARMIX) having a circulation pass manufactured by M•Technique Co., Ltd., to prepare a dispersion (emulsion) containing emulsified particles (oil droplets).

Then an initiator solution composed of 5.1 parts by weight of the polymerization initiator (KPS) dissolved in 240 ml of deionized water, and 750 ml of deionized water were added to the suspension, and the resulted system was heated and stirred for 12 hours at 98° C. for carrying out polymerization (the second step polymerization) to prepare a latex (a dispersion of composite resin articles each constituted by the high molecular weight resin particle covered with a intermediate molecular weight resin). Thus obtained latex was referred to as Latex 1HM.

Latex 1HM was dried and observed by a scanning electron microscope. A particle principally composed of Exemplified Compound 19 which was not surrounded by the latex particles was observed.

(3) Formation of Outer Layer (the Third Step Polymerization):

To thus obtained Latex 1HM, an initiator solution composed of 4.7 parts by weight of the initiator (KPS) dissolved in 200 ml of deionized water was added and a monomer mixture liquid composed of 300 parts by weight of styrene, 95 parts by weight of n-butyl acrylate, 15.3 parts by weight of methacrylic acid and 10.4 parts by weight of n-octyl-3-mercaptopropionic acid ester was dropped spending for 1 hour. After completion of the dropping, the resulted system was heated and stirred for 2 hours for carrying out the polymerization (the third step of polymerization) and then cooled by 28° C. Thus latex (a dispersion of composite particles having the core composed of the high molecular weight resin, the intermediate layer composed of the intermediate molecular weight resin and an outer layer composed of a low molecular weight resin and Exemplified Compound 19 was contained in the intermediate layer) was obtained which was referred to as Latex 1HML.

The composite resin particle constituting Latex 1HML had peaks of molecular weight at 138,000, 80,000 and 13,000. The weight average particle diameter of the composite resin particle was 122 nm.

In 1,600 ml of deionized water, 59.0 parts by weight of anionic surfactant 101 was dissolved. To the solution, 420.0 parts by weight of carbon black Regal 300, manufactured by Cabot Co., Ltd., was gradually added and dispersed by CLEAMIX manufactured by M-Technique Co., Ltd., for preparing a dispersion the colorant particle, hereinafter also referred to as Colorant Dispersion 1. As a result of the measurement of the particle diameter of the colorant particle by electrophoretic light scattering photometer ELS-800 manufactured by Ootsuka Denshi Co., Ltd., the weight average particle diameter was 89 nm.

Into a reaction vessel (four-mouth flask) on which a thermal sensor, a cooler, a nitrogen introducing device and a stirrer, 420.7 parts by weight (in terms of solid ingredient), 900 parts by weight of deionized water and 166 parts by weight of Colorant Dispersion 1 were charged and stirred. After adjusting the temperature of in the vessel to 30° C., pH value of the liquid was adjusted to 10.0.

And then a solution composed of 12.1 parts by weight of magnesium chloride-dissolved in 1,000 ml of deionized water was added spending 10 minutes while stirring at 30° C. After standing for 3 minutes, the liquid was heated by 90° C. spending a period of from 6 to 60 minutes for forming coagulated particles. The diameter of the coagulated particle was measured in such the situation by Coulter Counter TA-II, and a solution composed of 80.4 parts by weight of sodium chloride dissolved in 1,000 ml of deionized water was added at the time when the number average diameter is attained at 4 μm to stop the growing of the particles. The liquid was further heated and stirred for ripening at 98° C. for 2 hours so as to continue the phase separation.

Thereafter, the system was cooled by 30° C. and the pH is adjusted to 4.0, and then the stirring was stopped. The resulted coagulated particles were separated by a basket type centrifugal separator Mark III type No. 60×40 for forming a cake of the toner particles. The cake of the toner particles was washed in the basket type centrifugal separator and then moved to Flash Jet Dryer and dried until the moisture content is reduced by 0.5% by weight. Thus Toner Particle 1 was obtained. To 100 parts by weight of Toner Particle, 1.0 part by weight of Metal Oxide Particle 1 described in Table 1 and 0.6 parts by weight of hydrophobic silica having a primary particle diameter of 12 nm were added and mixed by Henschel mixer. The resulted mixture was sieved through a sieve having an opening of 45 μm to remove coarse particles to obtain Toner 1.

<<Preparation of Toner 2>>

(Preparation of Resin Fine Particle Dispersion)

A mixture liquid of 370 parts by weight of styrene, 30 parts by weight of n-butyl acrylate, 24 parts by weight of dodecanethiol and 4 parts by weight of carbon tetrachloride was emulsified in a solution composed of 6 parts by weight of a nonionic surfactant and 10 parts by weight of an anionic surfactant (dodecyl) dissolved in 550 parts by weight of deionized water and polymerized in an flask, and then 500 parts by weight of deionized water containing 4 parts by weight of ammonium persulfate was poured while slowly stirring. After exchanging air by nitrogen gas, the content of the flask was heated by 70° C. in an oil bath, and the emulsion polymerization was continued for 5 hours. Thus a fine particle dispersion of resin was obtained, in which resin particles having a diameter of 150 nm, a Tparts of 58° C. and a weight average molecular weight of 11,500 were dispersed. The content of the solid ingredient in the dispersion was 40% by weight.

(Preparation of Parting Agent Dispersion)

| | |
|---|---|
| Paraffin wax HNP0190 (Nihon Seirou Co., Ltd., melting point: 85° C.) | 100 parts by weight |
| Cationic surfactant Sanizol B50 (Kao Co., Ltd.,) | 5 parts by weight |
| Deionized water | 240 parts by weight |

The above components were dispersed for 10 minutes by a homogenizer ULTRATAX T50 (IKA Co., Ltd.) in a spherical stainless steel flask. After that, the dispersion was further subjected to a dispersing treatment by a pressing exhaustion type homogenizer to prepare Parting Agent Dispersion 2 having an average particle diameter of 550 nm.

(Preparation of Coagulated Particle)

| | |
|---|---|
| Resin fine particle dispersion | 234 parts |
| Colorant Dispersion 1 | 40 parts |
| Parting Agent Dispersion 2 | 40 parts |
| Poly (aluminum chloride) | 1.8 parts |
| Deionized water | 600 parts |

The above components were mixed and dispersed by the homogenizer ULTRATAX T50 (IKA Co., Ltd.) in a spherical stainless steel flask, and then heated by 55° C. in a heating oil bath while stirring. After standing for 30 minutes at 55° C., it was confirmed that coagulated particles having a D50 of 4.8 μm were formed. The temperature of oil bath was raised and held at 56° C. for 2 hours and the D50 was become 9.5 μm. After that, 32 parts by weight of the resin fine particle dispersion was added to the above dispersion containing the coagulated particles and the temperature of the oil bath was raised by 55° C. had held for 30 minutes. A 1N solution of sodium hydroxide solution was added to the dispersion containing the coagulated particles for adjusting the pH of the system to 5.0. The dispersion was closed in a stainless steel flask and heated by 95° C. while stirring using a magnetic seal and held for 6 hours and then cooled by the room temperature. After that, the solid ingredient was separated by the basket type centrifugal separator Mark III type No. 60×40, Matsumoto Kikai Co., Ltd., to form a cake of toner particles. The cake of the toner particles was washed in the centrifugal separator and dried by Flash Jet Drier, Seishin Kigyou Co., Ltd., until the moisture content was become by 0.5% by weight to obtain Toner Particle 2. To 100 parts by weight of Toner Particle 2, 1.0 part by weight of Metal Oxide Particle 2 described in Table 2 and 0.6 parts by weight of hydrophobic silica having a primary particle diameter of 12 nm were added and mixed by Henschel mixer, and then shaved by a sieve having a opening of 45 μm to remove coarse particles. Thus Toner 2 was obtained.

<<Preparation of Toner 3>>

One hundred and sixty five parts by weight of styrene, 35 parts by weight of n-butyl acrylate, 10 parts by weight of carbon black, 2 parts by weight of a di-t-butylsalicylic acid metal compound, 8 parts by weight of styrene-methacrylic acid copolymer and 20 parts by weight of paraffin wax having a melting point of 70° C. were heated by 60° C. and dissolved and dispersed by TK Homomixer, Tokushu Kika Kogyo Co., Ltd., at 12,000 rpm. To the resulted dispersion, 10 parts by weight of 2,2'-azobis(2,4-valeronitrile was added as a polymerization initiator and dissolved to prepare a polymerizable monomer composition.

Thereafter, 450 parts by weight of a 0.1M sodium phosphate solution was added to 710 parts by weight of deionized water, and 65 parts by weight of a 1.0M calcium chloride solution was gradually added while stirring by TK Homomixer at 13,000 rpm to prepare a suspension of calcium triphosphate. The forgoing polymerizable monomer composition was added to the above-prepared suspension and stirred for 20 minute by TK Homomixer at 10,000 rpm for preparing granules of the polymerizable monomer composition.

The polymerizable monomer composition was reacted for a period of from 5 to 15 hours at a temperature from 75 to 95° C., and then the calcium triphosphate was removed the hydrochloric acid. After that, the solid ingredient was separated by the basket type centrifugal separator Mark III type No. 60×40, Matsumoto Kikai Co., Ltd., for forming a cake of toner particles. The cake of the toner particles was washed in the centrifugal separator and dried by Flash Jet Drier, Seishin Kigyou Co., Ltd., until the moisture content was become by 0.5% by weight to obtain Toner Particle 3. To 100 parts by weight of Toner Particle 3, 1.0 part by weight of Metal Oxide Particle 3 described in Table 1 and 0.6 parts by weight of hydrophobic silica having a primary particle diameter of 12 nm were added and mixed by Henschel mixer, and then shaved by a sieve having a opening of 45 μm to remove coarse particles. Thus Toner 3 was obtained.

<<Preparation of Toner 4>>

(Preparation of Dispersion for Toner)

| | |
|---|---|
| Poly(vinyl butyral) (Constituted by 2% by weight of Poly(vinyl acetate) unit, 19% by weight of poly(vinyl alcohol) unit and 79% by weight of poly(vinyl acetal) unit, and has an average polymerization degree of 630) | 8 parts by weight |
| 2-methyl-2-butanol | 300 parts by weight |
| Styrene | 82 parts by weight |
| n-butyl acrylate | 18 parts by weight |

A mixture composed of the above-described was sufficiently dissolved and the following was added.

| | |
|---|---|
| Carbon black | 7 parts by weight |
| Glass beads | 500 parts by weight |

The resulted mixture was stirred by a paint shaker and the glass beads were removed by a mesh.

Into a polymerization vessel on which a stirrer and a nitrogen bubbling pipe were attached, 300 parts by weight of the above-obtained dispersion and 3.6 parts by weight of 2,2'-azo-bis(isobutylonitrile) were gradually poured while holding the temperature at 15° C. to form a polymerization reaction system. The dispersion ratio ψ of the colorant at this time was 1.01. The remaining amount of dissolved oxygen in the polymerization reaction system was 8.2 m parts by weight per liter.

The liquid was bubbled by nitrogen gas while holding the temperature at 20° C. by the remaining amount of the dissolved oxygen was become to 0.2 m parts by weight per liter. The system was heated by 75° C. and polymerization was carried out for 2 hours. The nitrogen bubbling was continued during the polymerization reaction.

The reaction system was cooled by 20° C. after the completion of the reaction. After that, the solid ingredient was separated by the basket type centrifugal separator Mark III type No. 6.0×40, Matsumoto Kikai Co., Ltd., for forming a cake of toner particles. The cake of the toner particles was washed in the centrifugal separator and dried by Flash Jet Drier, Seishin Kigyou Co., Ltd., until the moisture content was become by 0.5% by weight to obtain Toner Particle 4. To 100 parts by weight of Toner Particle 4, 1.0 part by weight of Metal Oxide Particle 3 described in Table 1 and 0.6 parts by weight of hydrophobic silica having a primary particle diameter of 12 nm were added and mixed by Henschel mixer, and then shaved by a sieve having a opening of 45 μm to remove coarse particles. Thus Toner 4 was obtained.

<<Preparation of Toner 5>>

(Preparation of Pigment Dispersion)

| | |
|---|---|
| Polyester resin (T part: 60° C., Softening point: 98° C., weight average molecular weight: 18,000) | 50 parts |
| Carbon black | 50 parts |
| Ethyl acetate | 100 parts |

Glass beads were added to the dispersion of the above composition and the mixture was charged in a sand mill disperser.

The mixture was dispersed for 3 hours in the high speed stirring mode while cooling around the dispersing vessel and diluted by ethyl acetate to prepare Colorant Dispersion 5 having a colorant concentration of 15% by weight.

(Preparation of Fine Particle of Wax)

| | |
|---|---|
| Paraffin wax | 15 parts |
| Toluene | 85 parts |

The above materials were put into a disperser having a stirring wings and a function of cycling a thermal medium around the vessel. The temperature was gradually raised by 100° C. while stirring at 83 rpm and further stirred for 3 hours at 100° C. After that, the liquid was cooled by the room temperature in a rate of about 2° C. per minute while continuing stirring to separate fine particles of the wax. The resulted wax dispersion was further subjected to dispersion while applying high pressure using a high pressure emulsifying apparatus APVAULIN HOMOGENIZER 15 MR. The particle size of the wax particle was 0.69 μm. Thus obtained dispersion of the fine particles of the wax was diluted by ethyl acetate so that the concentration of the wax was 15% by weight.

(Preparation of Oil Phase)

| | |
|---|---|
| Polyester resin (Glass transition point: 60° C., softening point: 98° C., weight average molecular weight: 18,000) | 85 parts |
| Colorant Dispersion 2 | 50 parts |
| Fine particle dispersion of wax (Wax concentration: 15% by weight | 33 parts |
| Ethyl acetate | 32 parts |

An oil phase having the above composition was prepared after the confirmation that the polyester resin could be sufficiently dissolved. The above composition was put into a homomixer ACE HOMOGENIZER, Nihon Seiki Co., Ltd., and stirred for 2 minutes at 16,000 rpm to prepare a uniform oil phase.

(Preparation of Water Phase)

| | |
|---|---|
| Calcium carbonate (Average particle diameter: 0.03 μm) | 60 parts |
| Pure water | 40 parts |

An aqueous solution of calcium carbonate was employed as water phase, which was obtained by stirring the above materials by a ball mill for 4 days.

The average particle size of calcium carbonate measured by a laser diffraction/scattering particle size distribution measuring apparatus LA-700 was 0.08 μm.

| | |
|---|---|
| Carboxymethyl cellulose, Cellogen BSH (Daiichi Kogyo Seiyaku Co., Ltd.) | 2 parts |
| Pure water | 98 parts |

A carboxymethyl cellulose solution by stirring the above materials by a ball mill was employed as water phase.

(Preparation of Spherical Particle)

| | |
|---|---|
| Oil phase | 55 parts |
| Water phase (Aqueous solution of calcium carbonate) | 15 parts |
| Water phase (Aqueous solution of carboxymethyl cellulose) | 30 parts |

The above materials were put into a colloid mill, manufactured by Nihon Seiki Co., Ltd., with a gap space of 1.5 mm and dispersed for 40 minutes at 9,400 rpm. The resulted emulsion was put into a rotary evaporator and the solvent was removed for 3 hours under a reduced pressure of 4 kPa at the room temperature. And then 12M hydrochloric acid was added until the pH of the emulsion was become to 2 for removing calcium carbonate from the toner particles. After that, 10N sodium hydroxide was added until the pH was become to 10, and the toner particles were stirred for 1 hour in an ultrasonic washing tank.

The solid ingredient was separated by the basket type centrifugal separator Mark III type No., 60×40, manufactured by Matsumoto Kikai Co., Ltd., for forming a cake of the toner. The cake of the toner was washed in the basket type centrifugal separator. The washed toner was moved to FLASH JET DRYER, manufactured by Seishin Kigyo Co., Ltd., and dried until the moisture content was become to 0.5% by weight to obtain Toner Particle 5. To 100 parts by weight of Toner Particle 5, 1.0 part by weight of Metal Oxide Particle 5 described in Table 1 and 0.6 parts by weight of hydrophobic silica having a primary particle diameter of 12 nm were added and mixed by HENSCHEL MIXER, and then shaved by a sieve having a opening of 45 μm to remove coarse particles. Thus Toner 5 was obtained.

<<Preparation of Toner 6>>

(Preparation of Polyether Resin a)

Into a high pressure reaction vessel having a stirrer, a nitrogen introducing device, a thermometer and a raw material inlet, 0.5 parts of potassium hydroxide and 200 parts of toluene as a solvent were put and a mixture liquid of 10.8 parts of propylene oxide and 89.2 parts of styrene oxide was gradually injected while stirring under the conditions of the pressure and the temperature of the system at 100 kPa and 40° C., respectively. The variation of the molecular weight was traced by a terminal group titration and the reaction was stopped at a time when the number average molecular weight is attained at 7,000. The injected amount of the monomers at this occasion was 8.64 parts of propylene oxide and 71.4 parts of styrene oxide. Toluene and unreacted monomers were removed by evaporation from thus obtained polymer solution under a reduced pressure of 4 kPa to obtain Polyether Resin A.

A colored resin molten at 180° C. composed of 18 parts of Polyether Resin A, 72 parts of polyester resin and 10 parts of carbon black was prepared by a two-axis continuous kneading machine. The molten resin was transferred to a rotation type continuous dispersing apparatus CABITRON 1010, manufactured by Euroteck Co., Ltd., in a rate of 100 parts by weight per minute. On the other hand, a diluted ammonia water of 0.37% by weight prepared by diluting a reagent ammonia water by deionized water was stored in an aqueous solvent tank and transferred to the CABITRON simultaneously with the colored molten resin while heating at 150° C. by a heat exchanger. Thus dispersion in which spherical fine particles of the colored resin were dispersed at 160° C. was obtained in the CABITRON under conditions of a rotating speed of the rotator of 7,500 rpm and a pressure of 50 kPa, and then the dispersion was cooled by 40° C. during a time of 30 seconds. The solid ingredient was separated by the basket type centrifugal separator Mark III type No., 60×40, manufactured by Matsumoto Kikai Co., Ltd., to form a cake of the toner. The cake of the toner was washed by water in the basket type centrifugal separator. The washed toner was moved to FLASH JET DRYER, manufactured by Seishin Kigyo Co., Ltd., and dried until the moisture content was become to 0.5% by weight to obtain Toner Particle 6. To 100 parts by weight of Toner Particle 6, 1.0 part by weight of Metal Oxide Particle 6 described in Table 1 and 0.6 parts by weight of hydrophobic silica having a primary particle diameter of 12 nm were added and mixed by HENSCHEL MIXER, and then shaved by a sieve having a opening of 45 μm to remove coarse particles. Thus Toner 6 was obtained.

<<Preparation of Toner 7>>

(Preparation of Polyester Resin B)

Into a high pressure reaction vessel, 715.0 g of dimethyl phthalate, 95.8 g of dimethyl sodium 5-sulfoisophthalate, 526.0 g of propanediol, 48.0 g of diethylene glycol, 247.1 g of dipropylene glycol and 1.5 g of butyltin hydroxide catalyst were charged. The mixture was heated by 190° C. and the temperature was further gradually raised by 200 to 202° C. while collecting sub produced and distillated methanol in a receiving vessel. And then the temperature was raised by 210° C. while the pressure was reduced from the atmospheric pressure by 1067 Pa. The product was taken out so as to prepare Polyester Resin B having a glass transition point of 53.8° C.

(Preparation of Polyester Resin Dispersion)

To 1,232 g of deionized water, 168 g of Polyester Resin B was added and stirred for 2 hours at 98° C. to prepare Polyester Resin Dispersion 7.

(Association Process)

In a reaction vessel, 1,400 g of Polyester Resin Dispersion 7 and 14.22 g of carbon black were charged and dispersed. Next, a 5 weight-% zinc acetate solution was prepared by dissolving zinc acetate in deionized water. The zinc acetate solution was charged in a storing vessel placed on a weighing apparatus which was connected to a pump capable of exactly supplying the zinc acetate solution in a rate of from 0.01 to 9.9 ml per minute. The amount of zinc acetate necessary for associating the dispersion was 10% of the weight of the resin in the dispersion.

The dispersion was heated by 56° C., and the zinc acetate solution-was supplied in a rate of 9.9 ml/minute to start the association. After addition of 60% by weight of the entire amount of zinc acetate (205 g of the 5 weight-% solution), the supplying rate of the pump was reduced to 1.1 ml/minute and the addition was continued until the added amount of the zinc acetate was become 10% by weight of the resin in the dispersion (335 g of the 5 weight-% solution). Thereafter the dispersion was stirred for 9 hours at 80° C.

The solid ingredient was separated by the basket type centrifugal separator Mark III type No., 60×40, manufactured by Matsumoto Kikai Co., Ltd., to form a cake of the toner. The cake of the toner was washed by water in the basket type centrifugal separator. The washed toner was moved to FLASH JET DRYER, manufactured by Seishin Kigyo Co., Ltd., and dried until the moisture content was become to 0.5% by weight to obtain Toner Particle 7. To 100 parts by weight of Toner Particle 7, 1.0 part by weight of Metal Oxide Particle 7 described in Table 1 and 0.6 parts by weight of hydrophobic silica having a primary particle diameter of 12 nm were added and mixed by HENSCHEL MIXER, and then shaved by a sieve having a opening of 45 μm to remove coarse particles. Thus Toner 7 was obtained.

<<Preparation of Toner 8>>

Toner 8 was prepared in the same manner as in Toner 1 except that Metal Oxide Particle 8 was employed in place of Metal Oxide Particle 1.

<<Preparation of Toner 9>>

Toner 9 was prepared in the same manner as in Toner 1 except that Metal Oxide Particle 9 was employed in place of Metal Oxide Particle 1.

<<Preparation of Toner 10>>

Toner 10 was prepared in the same manner as in Toner 1 except that Metal Oxide Particle 10 was employed in place of Metal Oxide Particle 1.

The physical properties of thus obtained toners are listed in Table 3.

TABLE 3

| Toner No. | Metal oxide particle No. | Particle with no corner (% in number) | Number variation coefficient in particle size distribution in number |
|---|---|---|---|
| 1 | 1 | 72.1 | 18.6 |
| 2 | 2 | 72.1 | 18.6 |
| 3 | 3 | 72.1 | 18.6 |
| 4 | 4 | 62.1 | 23.4 |
| 5 | 5 | 62.1 | 23.4 |
| 6 | 6 | 48.2 | 26.3 |
| 7 | 7 | 48.2 | 26.3 |
| Comparative 8 | Comparative 1 | 72.1 | 18.6 |
| Comparative 9 | Comparative 2 | 72.1 | 18.6 |
| Comparative 10 | Comparative 3 | 72.1 | 18.6 |

Preparation of Developer>>

Each of the Toners 1 through 10 was mixed with silicone resin coated ferrite carrier having a volume average particle diameter of 60 μm so that the toner concentration was 6% by weight to prepare Toners 1 through 10, respectively <<Evaluation>>

The each of Toners 1 through 10 was subjected to the following evaluation. The developers each corresponding to each toners were used.

A color printer C-1616, manufactured by Fuji Xerox Co., Ltd., available on the market was modified so that a photoreceptor having a diameter of 20 mm can be installed and employed to the evaluation of the toners.

The cleaning brush of the photoreceptor and the cleaning mechanism of the intermediate transfer member were removed for evaluation of the toners. The same toner and the developer were charged in the entire developing devices for four colors for clearly evaluating the properties of the developer.

The measurement of the fog and the image density was carried out by Macbeth Reflective Densitometer RD-918, manufactured by Macbeth Co., Ltd.

<Fog>

The fog was evaluated on the sold white image printed after 100,000 sheets of print. The absolute density of not printed paper (white paper) was measured at 20 points and the average of the measured values was defined as the density of white paper. Then the absolute density of the white image portion of the printed image was measured at 20 points and the average value was calculated. The difference of the average density and that of the white paper was evaluated as the density of the solid white image.

(Norms of Evaluation)

A: The density of the solid white image was not more than 0.005; excellent.

B: The density of the solid white image was from 0.006 to 0.008.

C: The density of the solid white image was not less than 0.009.

<Black Spot Caused by Damage>

The black spot caused by the damage on the heating roller surface was evaluated according to the number of black spot having a major diameter of not less than 0.4 mm in an A4 size solid white image printed after 100,000 sheets of printing. The major diameter of the black spot was confirmed by a microscope with a video printer.

(Norms of Evaluation)

A: The number of the black spot of not less than 0.4 mm was three or less per an A4 size image.

B: The number of the black spot of not less than 0.4 mm was from 4 to 12 per an A4 size image.

C: The number of the black spot of not less than 0.4 mm was 13 or more per an A4 size image.

<White Spot>

The white spot caused by the damage on the photoreceptor surface was evaluated according to the number of the white spot having a major diameter of not less than 0.4 mm in an A4 size solid black image printed after 100,000 sheets of printing. The major diameter of the white spot was confirmed by a microscope with a video printer.

(Norms of Evaluation)

A: The number of the white spot of not less than 0.4 mm was three or less per an A4 size image.

B: The number of the white spot of not less than 0.4 mm was from 4 to 12 per an A4 size image.

C: The number of the white spot of not less than 0.4 mm was 13 or more per an A4 size image.

<Halftone White Line Image>

The occurrence of halftone white line in a solid black image is evaluated by the number of the halftone white line having a width of not less than 0.4 mm, which is caused by the insufficient discharge due to the toner particle or external additive scattered and adhered to the charging wire of the charging device, in an A4 size solid black image. The width of the halftone white line was confirmed by a microscope with a video printer.

(Evaluation Norms)

A: The number of halftone white line having a width of not less than 1 mm was three or less per an A4 size image; no problem is caused in practical use, Good.

B: The number of halftone white line having a width of not less than 1 mm was from 4 to 12 per an A4 size image.

C: The number of halftone white line having a width of not less than 1 mm was not less than 13 per an A4 size image.

<Transfer Repelling of Toner Occurred Under Low Temperature and Humidity Conditions>

A halftone image having a relative density of from 0.2 to 0.3 was printed on 32 sheets of 200 g paper, manufactured by Rank Xerox Co., Ltd., under low temperature and moisture condition (10° C., 20% RH) and transfer repelling of the toner caused by peeling discharge at the later end of the image on the occasion of the separation of the image receiving material from the photoreceptor was visually confirmed.

A: No sheet showing the transfer repelling of the toner was observed; excellent.

B: Transfer repelling capable of being confirmed only by staring was observed on one or two sheets of the printed image; good.

C: Clear transfer repelling was observed on three or more sheets of the printed image; poor.

<Degradation of Charging Property>

The charging amount of the toner in the developer was measured by a blow-off method at the time of the initial of image formation and that after completion of printing of 100,000 sheets under normal condition (20° C., 55% RH). The charging amount of the time of the initial and the completion of the printing were compared to evaluate the degradation of the charging ability. The charging amount was measured by a blow-off charging amount measuring apparatus TB-200, manufactured by Toshiba Chemical Co., Ltd., was employed.

(Norms of Evaluation)

A: The difference between the initial time and the completion time of 100,000 prints was less 2.0 μC/g; excellent.

B: The difference between the initial time and the completion time of 100,000 prints was from 2.0 to 5.0 μC/g; good.

C: The difference between the initial time and the completion time of 100,000 prints was more than 6.0 μC/g; the variation of the charging amount is large.

<Increasing of Charging Amount Under Low Temperature and Humidity Conditions>

Under a low temperature and humidity condition (10° C., 20% RH), printing of 50,000 sheets was carried out and the charging amount and the image density at the initial time and after completion of the 50,000 sheets of printing. The charging amount of the developer sampled from the four developing devices was measured by the blow-off charging amount measuring apparatus TB-200, manufactured by Toshiba Chemical Co., Ltd.

(Norms of Evaluation)

A: The increasing of the charging amount during the initial time to the completion time of 50,000 prints was less than 3.0 μC/g and the decreasing of the image density was less than 0.01; excellent.

B: The increasing of the charging amount during the initial time to the completion time of 50,000 prints was from 3.0 to 6.0 μC/g and the decreasing of the image density was less than 0.04; good.

C: The increasing of the charging amount during the initial time to the completion time of 50,000 prints was more than 6.0 μC/g and the decreasing of the image density was not less than 0.04.

<Life of Developer>

A cartridge for 30,000 prints, according to the specification of the manufacturer, was employed and the developer was moved to new cartridge for every 30,000 prints to continue the durability test of the developer, and the usability of developer was judged by the visible observation of the quality of the printed image.

(Norms of Evaluation)

A: The image quality was not degraded until 600,000 prints; the life of the developer is extremely long and satisfactory.

B: The image quality was degraded between 300,000 to 600,000 prints; the life of the developer was long and satisfactory.

C: The image quality was degraded between 60,000 to 290,000 prints; the life of the developer was short a little.

D: The image quality was degraded between 30,000 to 50,000 prints; the life of the developer was short.

<Storage Stability>

One gram of each of the toner was put in a glass sample tube and stood in a thermostat for 48 hours at 50° C. and 90% RH. After that, the toner was sieved through a 28 mesh test sieve and granules remaining on the mesh were weighed. The storage ability was evaluated according to the occurrence ratio of the granules.

(Norms of Evaluation)

A: The occurrence ratio of the granules was less than 10%; the storage stability was excellent.

B: The occurrence ratio of the granules was from 10% to less than 30%; the storage stability was good.

C: The occurrence ratio of the granules was 30% or more.

<Releasing of External Additive>

The surface of the carrier after 100,000 prints was observed by an electric field effect scanning electron microscope with a magnitude of 40,000 to evaluate the adhesion state of the external additive on the carrier surface.

(Norms of Evaluation)

A: The external additive released from the toner was almost not adhered in the carrier surface.

B: Two to ten particles per 1 μm square area of the external additive released from the toner were observed, but the charging hindrance did not occur.

C: Thirty or more particles per 1 μm square area of the external additive released from the toner were observed, and the charging amount was decreased by 10 μC/g part or more compared with the initial of the printing, and scattering of the toner and fogging occurred.

<Suitability for Cleanerless Process>

The following ranking was carried out between 30,000 prints according to the specification of the manufacturer.

A: Contamination of the charging roller by the toner and white line caused by contamination of transfer roller were not caused at all, and the fine line image just before printed was not appeared on the next image at all; excellent.

B: Contamination of the charging roller by the toner and white line caused by contamination of transfer roller could not be detected. Though the fine line image just before printed was rarely appeared on the next image, no problem was posed since the line image could be detected only by staring; good.

C: Contamination of the charging roller by the toner and white line caused by contamination of transfer roller occurred, and the fine line image just before printed was clearly detected on the next image.

Results of the evaluations are listed in Table 4.

TABLE 4

| Toner No. | Fogging of image | Black spot caused by damage | White spot | Halftone whit line | Repelling of transferring under low temperature and humidity condition | Degradation of charging ability | Increasing of charging amount under low temperature and humidity condition | Life of developer | Storage stability | Releasing of external additive | Suitability for cleanerless process |
|---|---|---|---|---|---|---|---|---|---|---|---|
| 1 | A | A | A | A | A | A | A | A | A | A | A |
| 2 | A | A | A | B | B | A | A | A | A | A | A |
| 3 | A | A | A | B | B | A | A | A | A | A | A |
| 4 | A | A | A | A | A | A | A | A | A | B | B |
| 5 | A | A | A | A | A | A | A | A | A | B | B |
| 6 | A | A | A | B | B | A | B | B | A | B | B |
| 7 | A | A | A | B | B | A | B | B | A | B | B |
| Comparative 8 | C | B | B | C | C | C | C | B | A | B | C |
| Comparative 9 | B | C | C | C | C | B | B | D | B | C | C |
| Comparative 10 | C | B | B | C | C | C | C | B | B | B | C |

As is cleared in Table 4, good images without any fogging, black spot, white spot and halftone white line can be formed by Toners 1 through 7 even when the printing is repeatedly performed. These toners each show excellent properties such as that the charging amount is high, the charging amount is not increased under the low temperature and humidity, the life is long, the storage ability is high and the external additive is not released. Moreover, the printer can be made compact since the toners have the high suitability for the cleanerless process.

<Part 2>

<<Preparation of External Additive>>

<Preparation of External Additives 1 Through 6>>

Solutions in each of which the mixing ratio of hexamethyldisiloxane and titanium tetrachloride was changed so that X in Formula 1 was made to intended value were each supplied in a liquid state at the room temperature to the burner provided at the top of the vertical burning furnace, and sprayed into fine droplets by air as the spraying medium from the spraying nozzle provided at the end of the burner, and combusted by the assistant flame of burning of propane. Oxygen and air were supplied as the combustion holding gas from the burner. The fine particles formed by the combustion were recovered by the cyclone and the bag filter. Thus External Additives 1 through 6 each containing titanium were obtained.

<Preparation of External Additives 7 Through 11>

External Additives 7 through 11 each containing titanium were obtained in the same manner as in External Additive 1 except that isopropyltriisostearoyl titanate was employed in place of titanium tetrachloride.

<Preparation of External Additive 12>

External Additive 12 containing magnesium was obtained in the same manner as in External Additive 1 except that magnesium dichloride was employed in place of titanium tetrachloride.

<Preparation of External Additive 13>

External Additive 13 containing aluminum was obtained in the same manner as in External Additive 1 except that aluminum trichloride was employed in place of titanium tetrachloride.

<Preparation of External Additive 14>

External Additive 14 containing tin was obtained in the same manner as in External Additive 1 except that tin trichloride was employed in place of titanium tetrachloride.

<Preparation of External Additive 15>

External Additive 15 containing germanium was obtained in the same manner as in External Additive 1 except that germanium trichloride was employed in place of titanium tetrachloride.

<Preparation of External Additive 16>

External Additive 14 containing zinc was obtained in the same manner as in External Additive 1 except that zinc dichloride was employed in place of titanium tetrachloride.

<Preparation of External Additive 17>

A solutions in which the mixing ratio of hexamethyldisiloxane and titanium tetrachloride was changed so that X in Formula 1 was made to 0.004 was supplied in a liquid state at the room temperature to the burner provided at the top of the vertical burning furnace, and sprayed into fine droplets by air as the spraying medium from the spraying nozzle provided at the end of the burner, and combusted by the assistant flame of burning of propane. Oxygen and air were supplied as the combustion holding gas from the burner. The fine particles formed by the combustion were recovered by the cyclone and the bag filter. Thus External Additive 17 containing titanium was obtained.

<Preparation of External Additive 18>

A solutions in which the mixing ratio hexamethyldisiloxane and titanium tetrachloride was changed so that X in Formula 1 was made to 0.008 was supplied in a liquid state at the room temperature to the burner provided at the top of the vertical burning furnace, and sprayed into fine droplets by air as the spraying medium from the spraying nozzle provided at the end of the burner, and combusted by the assistant flame of burning of propane. Oxygen and air were supplied as the combusting holding gas from the burner. The fine particles formed by the combusting were recovered by the cyclone and the bag filter. Thus External Additive 18 containing titanium was obtained.

<Preparation of External Additive 19>

A solutions in which the hexamethyldisiloxane and titanium tetrachloride was changed so that X in Formula 1 was made to 0.6 was supplied in a liquid state at the room temperature to the burner provided at the top of the vertical burning furnace, and sprayed into fine droplets by air as the spraying medium from the spraying nozzle provided at the end of the burner, and combusted by the assistant flame of burning of propane. Oxygen and air were supplied as the combustion holding gas from the burner. The fine particles formed by the combustion were recovered by the cyclone and the bag filter. Thus External Additive 19 containing titanium was obtained.

<<Preparation of colored particle>>

Toner materials composed of 100 kg of styrene-n-butyl acrylate, 10 kg of carbon black and 4 kg of polypropylene were preliminarily mixed by HENSCHEL MIXER, molten and kneaded by a double-axis extruder, roughly crushed by a hammer mill, finely powdered by a jet crusher and classified by a wind classifier to obtain Colored Particle having a volume average diameter of 8 μm.

<<Preparation of Toner>>

The foregoing Colored Particle was mixed with each of the external additives 1 through 19 by HENSCHEL MIXER to prepare Toners 1 through 19.

The structural formulas, X, X −1, 2−2X+aX/2 and the number average primary particle diameter of the external additives and the adding amount of the external additives to Colored Particle are listed in Table 5.

TABLE 5

| | External additive | | | | | Adding |
|---|---|---|---|---|---|---|
| | Structural | Formula 1 | | | Primary particle diameter | amount of external additive |
| Toner No. | formula | X | 1 − X | 2 − 2X + aX/2 | (nm) | (weight-%) |
| 1 | $Si_{0.99}Ti_{0.01}O_2$ | 0.01 | 0.99 | 2 | 75 | 1.0 |
| 2 | $Si_{0.97}Ti_{0.03}O_2$ | 0.03 | 0.97 | 2 | 110 | 1.0 |
| 3 | $Si_{0.92}Ti_{0.08}O_2$ | 0.08 | 0.92 | 2 | 160 | 1.0 |
| 4 | $Si_{0.90}Ti_{0.10}O_2$ | 0.1 | 0.90 | 2 | 115 | 0.5 |
| 5 | $Si_{0.90}Ti_{0.10}O_2$ | 0.1 | 0.90 | 2 | 115 | 1.0 |
| 6 | $Si_{0.90}Ti_{0.10}O_2$ | 0.1 | 0.90 | 2 | 115 | 3.0 |
| 7 | $Si_{0.85}Ti_{0.15}O_2$ | 0.15 | 0.85 | 2 | 80 | 1.0 |
| 8 | $Si_{0.70}Ti_{0.30}O_2$ | 0.3 | 0.70 | 2 | 150 | 1.0 |
| 9 | $Si_{0.65}Ti_{0.35}O_2$ | 0.35 | 0.65 | 2 | 70 | 1.0 |
| 10 | $Si_{0.60}Ti_{0.40}O_2$ | 0.4 | 0.60 | 2 | 75 | 1.0 |
| 11 | $Si_{0.50}Ti_{0.50}O_2$ | 0.5 | 0.50 | 2 | 120 | 1.0 |
| 12 | $Si_{0.90}Al_{0.10}O_{1.9}$ | 0.1 | 0.90 | 1.9 | 75 | 1.0 |
| 13 | $Si_{0.90}Mg_{0.10}O_{1.95}$ | 0.1 | 0.90 | 1.95 | 250 | 1.0 |
| 14 | $Si_{0.90}Sn_{0.10}O_2$ | 0.1 | 0.90 | 2 | 150 | 1.0 |
| 15 | $Si_{0.90}Ge_{0.10}O_2$ | 0.1 | 0.90 | 2 | 80 | 1.0 |
| 16 | $Si_{0.90}Zn_{0.10}O_{1.9}$ | 0.1 | 0.90 | 1.9 | 250 | 1.0 |
| 17 | $Si_{0.996}Ti_{0.004}O_2$ | 0.004 | 0.996 | 2 | 90 | 1.0 |
| 18 | $Si_{0.992}Ti_{0.008}O_2$ | 0.008 | 0.992 | 2 | 95 | 1.0 |
| 19 | $Si_{0.40}Ti_{0.60}O_2$ | 0.6 | 0.40 | 2 | 110 | 1.0 |

<<Preparation of Double-Component Developer>>

Silicone resin coated ferrite carrier having a volume average particle diameter of 60 μm was mixed with each of the above-prepared Toners 1 through 19 so that the toner concentration was made to 6% by weight to prepare Developers 1 through 19.

Each of Toners 1 through 19 was evaluated by employing the following laser digital copying machine.

<<Apparatus for Evaluation>>

A laser digital copying machine Konica 7050, manufactured by Konica Corp., was set at the following conditions.

(Fixing Condition)

The fixing system was a thermal fixing by a heating roller and a pressure roller contacted to the heating roller.

The heating roller was a cylindrical tube of an aluminum alloy with a thickness of 1 mm having a inner diameter of 40 mm and a total width of 310 mm which includes a heater at the central portion thereof and covered with silicone rubber sponge having an Ascar C hardness of 30 and a thickness of 8 mm, and the surface of the rubber sponge was further covered by a tube of 120 μm of PFA (tetrafluoroethylene-perfluoroalkyl vinyl ether copolymer). As the pressure roller, an iron core having a thickness of 2 mm and an inner diameter of 40 mm covered with silicone rubber sponge having an Ascar C hardness of 48 and a thickness of 2 mm was employed.

The nip width of the heating roller and the pressure roller was 5.8 mm. The line speed of printing was set at 250 mm/sec using such the fixing device.

For the cleaning system of the fixing device, a supplying method by a web impregnated with polydiphenylsilicon having a viscosity of 10 Pa·s at 20° C.

The fixing temperature was set at 175° C. controlled by the surface temperature of the heating roller and. The coating amount of the silicone oil was 0.6 mg/A4 size sheet.

<<Image Formation>>

Each of Developers 1 through 19 was successively charged in the evaluating apparatus to respectively print images by Toner 1 through 19. The printing of an image of A4 size having an image ratio of 5% was continuously preformed by 100,000 sheets under a normal temperature and humidity condition (25° C., 50% RH). After completion of 100,000 sheets of printing, 10 prints of an original image were printed and evaluated. The original image was composed of a character image having a pixel ratio of 7%, a halftone image, a solid white image and a solid black image each occupying quarter area.

<<Evaluation Items>>

<Charging Amount>

The charging amount of the toner was measured by the blow-off method at the initial time and after 100,000 prints and the measurement results were compared. The blow-off charge measuring apparatus TB-200, manufactured by Toshiba Chemical Co., Ltd., was employed for measurement of the charging amount.

<Fog>

The absolute density of not printed paper (white paper) was measured at 20 points and the average of the measured values was defined as the density of white paper. Then the absolute density of the white image portion of the printed image was measured at 20 points and the average value was calculated. The difference of the average density and that of the white paper was evaluated as the density of the solid white image.

(Norms of Evaluation)

Density of the solid white image was not more than 0.005: Good.

Density of the solid white image was from 0.006 to −0.008: No problem for practical use.

Density of the solid white image was not less than 0.009: Not acceptable.

<Surface Condition of Heating Roller>

After the 100,000 prints, the condition of the surface of the heating roller was visually observed for checking the occurrence of damage.

<Black Spot Caused by Damage>

The black spot caused by the damage on the heating roller surface was evaluated according to the number of black spot having a major diameter of not less than 0.4 mm in an A4 size solid white image. The major diameter of the black spot was confirmed by a microscope with a video printer.

(Norms of Evaluation)

The number of the black spot of not less than 0.4 mm was three or less per an A4 size image: Good.

The number of the black spot of not less than 0.4 mm was from 4 to 12 per an A4 size image: No problem for practical use.

The number of the black spot of not less than 0.4 mm was 13 or more per an A4 size image: not acceptable.

The evaluation results of the charging amount and the variation thereof at the initial and completion of printing, the surface condition of the heating roller after completion of the printing, the fog and the black spot are listed in Table 6.

TABLE 6

| | Charging amount | | | After completion | | |
|---|---|---|---|---|---|---|
| | | | | Surface condition | Printed image | |
| Toner No. | Initial time (μQ/g) | After completion (μQ/g) | Completion - Initial (μQ/g) | of heating roller | Fog | Black spots Number/A4 size |
| 1 | 32 | 30 | −2 | No damage occurs. | 0.003 | 3 |
| 2 | 35 | 34 | −1 | No damage occurs. | 0.003 | 2 |
| 3 | 31 | 30 | −1 | No damage occurs. | 0.002 | 1 |
| 4 | 34 | 34 | 0 | No damage occurs. | 0.001 | 1 |
| 5 | 34 | 32 | −2 | No damage occurs. | 0.001 | 0 |
| 6 | 32 | 33 | +1 | No damage occurs. | 0.002 | 0 |
| 7 | 36 | 33 | −3 | No damage occurs. | 0.001 | 0 |
| 8 | 34 | 32 | −2 | No damage occurs. | 0.002 | 1 |
| 9 | 35 | 34 | −1 | No damage occurs. | 0.002 | 0 |
| 10 | 33 | 31 | −2 | No damage occurs. | 0.003 | 2 |
| 11 | 32 | 30 | −2 | No damage occurs. | 0.003 | 2 |
| 12 | 35 | 33 | −2 | No damage occurs. | 0.002 | 1 |
| 13 | 36 | 34 | −2 | No damage occurs. | 0.002 | 0 |
| 14 | 35 | 33 | −2 | No damage occurs. | 0.001 | 1 |
| 15 | 35 | 33 | −2 | No damage occurs. | 0.002 | 2 |
| 16 | 36 | 34 | −2 | No damage occurs. | 0.001 | 0 |
| 17 | 35 | 22 | −13 | Damage occurs. | 0.010 | 15 |
| 18 | 34 | 24 | −10 | Damage occurs a little | 0.009 | 18 |
| 19 | 22 | 13 | −9 | Damage occurs. | 0.015 | 17 |

As is cleared in Table 6, Toners 1 to 16 show superior evaluation results in the fog and black spot to Toners 17 through 19.

By Toners 1 through 16, images could be stably formed in which the fogging caused by the lowering of the charging amount and the black spot caused by the damage on the heating member did not occur.

In the foregoing Parts I and II of Examples, the following items could be realized.

The toner and the external additive could be found by which the external additive was not released from the toner particle surface so that the electrostatic developing toner capable of prolonging the life of the developer, and the image forming method employing such the developer could be provided.

The toner and the image forming method employing the toner could be provided in which the external additive was not released from the toner particle surface so that the occurrence of irregular points on the fixing roller or the photoreceptor surface and the black spot and white spot caused by the irregular point was prevented.

The toner and the image forming method employing the toner could be provided in which occurrence of the uneven charge caused by the contamination of the charging device was prevented so that the formation of the halftone white line was prevented.

The toner and the image forming method employing the toner suitable for the cleanerless process could be provided in which the variation and increasing of the charging ability caused by the addition of the external additive was inhibited, the sufficient transferring without transfer repelling.

The toner and the image forming method employing the toner having high storage ability in which the external additive was not buried even when a large amount of external additive was employed, and the fluidity of the toner could be held when the toner was stood at high temperature.

The particle A was not buried in the toner particle and not released from the toner particle surface. Therefore, good image could be obtained in which the fogging, black spot, white spot and halftone white line did not occur. In the toner, the charging amount was stable and not increased under the low temperature and low humidity condition, the life of the developer was prolonged, the storage ability was high, and the releasing of the external additive did not occur and the suitability for the cleanerless process was high.

The particle A was not scattered since the toner particle A was trapped on the surface of the toner particle so as to be not adhered to the carrier surface. Accordingly, the life of the developer was prolonged.

The toner exhibited high suitability for the cleanerless process in which cleaning of the remaining toner was not necessary since the electric resistance of the particle A was suitable for raising the transferring ratio.

The charging amount of the developer and the toner was stably maintained even when the printing was repeatedly performed and the charging amount was not increased under the low temperature and low humidity condition and occurrence of fogging was inhibited since the particle A was difficultly moved to the surface of the carrier.

The grinding damage on the surface of the photoreceptor and the fixing roller was difficultly formed and the occurrence of the black spot and white spot could be inhibited.

The toner employing the metal oxide particle as the external additive had high fluidity and the formation of the granule could be prevented even when the toner was stored at high temperature since the particle diameter of the particle A was large.

What is claimed is:

1. A toner for developing an electrostatic charge image comprising a resin, a colorant, and a particle having domain matrix structure having two or more kinds of metal elements;

wherein the matrix is amorphous and the domain contains a crystal, and the particle contains the component represented by the following Formula 1:

$$Si_{(1-X)}M_XO_{(2-2X+aX/2)}, \quad \text{Formula 1}$$

wherein X is from 0.01 to 0.5, M is a mono- through tetra-valent metal element and a is valent number of the metal element represented by M.

2. The toner of claim 1, wherein the matrix of the particle is silica.

3. The toner of claim 1, wherein the domain comprises a titanium compound.

4. The toner of claim 1, wherein the domain comprises an aluminum compound.

5. The toner of claim 1, wherein the domain comprises a zirconium compound.

6. The toner of claim 1, wherein the number based average primary particle diameter of the particle is within the range of from 10 to 300 nm and the number based average horizontal FERE diameter is within the range of from 1 to 60 nm.

7. The toner of claim 1, wherein the toner contains the particle having a primary particle diameter within the range of from 10 to 300 nm and the particle has the domain having a horizontal FERE diameter of the particle is within the range of from 1 to 60 nm.

8. The toner of claim 1, wherein the toner is capsuled or decorated by a resin different from the resin of the toner.

9. The toner of claim 1, wherein the ratio of the particles having no corner in the toner particles constituting the toner is not less than 50% by number and the number variation coefficient in the number distribution of particle size is not more than 27%.

10. The toner of claim 1, wherein the metal elements are at least two kinds of metal elements selected from the group consisting of Si, Ti, Mg, Al, Sn, Ge, Zr and Zn.

11. The toner of claim 1, wherein the adding amount of the particle is from 0.1 to 4% by weight of the whole weight of the toner.

12. An image forming method comprising the steps of forming a toner image formed by the toner for developing an electrostatic charge image of claim 1 on a image support, and fixing the toner image onto the image support by passing the toner image between a heating member and a pressing member.

13. The image forming method of claim 12, wherein the matrix of the particle is silica.

14. The image forming method of claim 12, wherein the domain is a titanium compound, an aluminum compound or a zirconium compound.

15. The image forming method of claim 12, wherein the number based average primary particle diameter of the particle is within the range of from 10 to 300 nm and the number based average horizontal FERE diameter is within the range of from 1 to 60 nm.

16. The image forming method of claim 12, wherein the toner contains the particle having a primary particle diameter within the range of from 10 to 300 nm and the particle has a domain having a horizontal FERE diameter of the particle is within the range of from 1 to 60 nm.

17. The image forming method of claim 12, wherein the toner is capsuled or decorated by a resin different from the resin of the toner.

18. The image forming method of claim 12, wherein the ratio of the particles having no corner in the toner particles constituting the toner is not less than 50% by number and the number variation coefficient in the number distribution of particle size is not more than 27%.

19. The image forming method of claim 12, wherein the metal elements are at least two kinds of metal elements selected from the group consisting of Si, Ti, Mg, Al, Sn, Ge, Zr and Zn.

20. The image forming method of claim 12, wherein the adding amount of the particle is from 0.1 to 4% by weight of the whole weight of the toner.

* * * * *